US006385417B1

(12) United States Patent
Tanaka et al.

(10) Patent No.: US 6,385,417 B1
(45) Date of Patent: May 7, 2002

(54) HOLDING STRUCTURE OF IMAGE HOLDING MEMBER IN IMAGE FORMING SYSTEM

(75) Inventors: Toshiaki Tanaka, Fukaya; Yoshitsugu Nakatomi, Yokosuka, both of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/612,386

(22) Filed: Jul. 7, 2000

(51) Int. Cl.[7] ..... G03G 15/00
(52) U.S. Cl. ..... 399/164; 399/159
(58) Field of Search ..... 399/159, 164

(56) References Cited

U.S. PATENT DOCUMENTS 4,258,372 A * 3/1981 Ishikawa ..... 347/149
5,223,893 A * 6/1993 Ikemoto et al. ..... 399/111
6,173,145 B1 * 1/2001 Chadani et al. ..... 399/265

FOREIGN PATENT DOCUMENTS

JP 8-286561 11/1996

* cited by examiner

*Primary Examiner*—Quana M. Grainger
(74) *Attorney, Agent, or Firm*—Foley & Lardner

(57) ABSTRACT

An image forming unit includes a photosensitive drum as an image holding member for converting an optical image formed via an optical system into a latent image and subsequently depositing a developing material thereon to hold the image. The apparatus also includes a developing roller as a developing portion for supplying the developing material to develop the latent image held on the photosensitive drum to the image with the developing material. The apparatus further includes a gap regulating mechanism for setting bearings, disposed on both ends of a rotation drive shaft of the photosensitive drum, for rotatably fixing the photosensitive drum to a system main body frame and bearings, disposed on both ends of the developing roller, for rotatably supporting a rotation drive shaft of the developing roller by a developing portion main body. With such a unit, a peripheral surface of the photosensitive drum always maintains a constant gap from the peripheral surface of the developing roller.

18 Claims, 17 Drawing Sheets

HOLDING STRUCTURE OF IMAGE HOLDING MEMBER IN IMAGE FORMING SYSTEM

BACKGROUND OF THE INVENTION

The present invention relates to image forming systems such as a color plain paper copy machine (hereinafter referred to as PPC) and a printer for printing/recording information from image information supply apparatuses such as a personal computer (hereinafter referred to as PC) and a digital camera on a plain paper, OHP sheet or other types of paper sheets, and particularly, it relates to a structure for holding an image holding member while a constant fine gap is always maintained on an abutment surface between a photosensitive drum or another image holding member and a developing roller.

An image forming system for use in the aforementioned purpose is provided with an image forming unit for forming an image by using a developing material, a sheet supply portion for supplying a sheet to the image forming unit, a sheet conveying portion for conveying the supplied sheet, and a sheet supplying/conveying controller for controlling the supplying/conveying of the sheet to the image forming unit by the sheet supplying and conveying portions. The image forming unit is provided with an image holding member for converting an optical image formed via an optical system into a latent image and subsequently depositing the developing material thereon to hold the image, a developing unit for developing the latent image held on the image holding member as the image with the developing material, a transferring unit for transferring the developed image to the sheet, and a fixing unit for fixing the transferred image.

In recent years, in a field of image forming system, various color developing/forming methods for forming color images have been proposed, and there are roughly a multiple transferring system and a multiple developing system. The multiple transferring system can be classified into a transferring drum system, a tandem system, an intermediate transferrer system, and the like, and the multiple developing system can be classified to a multiple rotation system and a one pass method. The transferring drum system comprises successively transferring respective color toners on a sheet wound around a transferring drum to obtain the image, and is characterized in that a positioning control is difficult but a degree of freedom in a process design is high. The tandem system is provided with image forming portions for four colors, successively transfers respective color toner images on a conveyed sheet to obtain the color image with one pass, and is high in cost and difficult in the positioning control, but is also provided with an advantage that image formation can be accelerated and a degree of freedom in process design is highest. The intermediate transferrer system comprises successively transferring respective color toner images on an intermediate transferrer, and subsequently collectively transferring the images to the sheet to obtain the color image, and is difficult in the positioning control and low in transfer ratio as compared with the other systems but has advantages that a transferring mechanism portion capacity is relatively small and that curvature separation is also possible.

Moreover, the multiple rotation system in the multiple developing system comprises rotating the photosensitive drum to superposing the respective color toners on the surface, and subsequently collectively transferring the toners to the sheet to obtain the color image, and requires a complicated process control, but is advantageous in miniaturization of a machine body and cost reduction, and has an advantage that the system is also advantageous for positioning. The one pass system is provided with the image forming portions for four colors around a photosensitive member, comprises superposing the toner images on the photosensitive member with one pass to obtain the color image, has difficulty in process arrangement around the photosensitive member and exposure positioning control, easily enlarges an apparatus size, and disadvantageously requires the complicated process control, but has an advantage that image formation can be performed at a high speed.

For the aforementioned image holding member for holding the image in an image forming process, in the aforementioned various image forming systems, concretely, there is one large-diameter photosensitive drum, or there are a plurality of relatively small-diameter photosensitive drums for respective colors in color copy or the like, but any member comprises a single photosensitive drum or a plurality of photosensitive drums as a constituting element of the image forming unit. The photosensitive drum is rotatably supported on a frame constituting a main body of the image forming system via a bearing or the like, and for the single photosensitive drum or the plurality of photosensitive drums a magnet roller for supplying the developing material is also disposed.

The developing magnet roller is disposed in parallel between a developing unit main body case and the photosensitive drum, and is used for attaching a toner as the developing material on an electrostatic pattern to form a visualized image after the electrostatic pattern is formed on the photosensitive drum charged with a static electricity by a charger in accordance with a document pattern by exposure by an optical unit. Therefore, by applying a bias potential of either a positive potential or a negative potential to the developing (magnet) roller to attach the developing material to the peripheral surface of the roller as an electromagnet and rotating the roller opposite to the photosensitive drum with a constant gap immediately before placing the roller in sliding contact with the peripheral surface of the drum, the toner is supplied to the surface of the rotating photosensitive drum which is charged in a predetermined document pattern and on which an electric latent image is formed.

As seen from the aforementioned description, since the photosensitive drum is disposed close to the developing roller to such an extent that the peripheral surfaces are nearly in the sliding contact with each other, a gap control is a big problem to secure an adequate supply amount of the developing material (toner). Particularly, in a recent technique it is a mainstream to integrally forming the photosensitive drum and developing (magnet) roller including the developing unit main body case, and it is very important to control the gap in arranging these components for every unit.

In the conventional image forming system, in order to control the gap between the peripheral surface of the photosensitive drum and the peripheral surface of the developing roller, an adjustment portion for the gap control is disposed in either edge of both ends avoiding a central portion for forming the image in the photosensitive drum, and a gap setting member fixed to a developing roller shaft is disposed opposite to the adjustment portion, and controlled by direct contact in such a manner that a constant distance is always held from the peripheral surface of the photosensitive drum (direct contact system). The gap setting member is provided with a disc shape or a thin cylindrical shape such that the peripheral surface abuts on the adjustment portion disposed on at least one edge of the peripheral surface of the photosensitive drum, and may be constituted, for example, by a bearing comprising an inner race fixed to the developing roller shaft and an outer race rotatably held via a plurality of rollers.

In the conventional image forming system constituted as described above, since the gap between the photosensitive drum and the developing roller is directly adjusted by the surface extended from the surface with the image to be formed thereon, distortion and rattling generated between a rotation drive shaft of the photosensitive drum and the rotation drive shaft of the developing roller, and disturbance forces such as cogging generated in a motor for rotating/driving both drive shafts are applied without being inhibited.

However, according to a conventional image forming device, collision of the peripheral surface of the photosensitive drum against the peripheral surface of the developing roller is avoided by the gap setting member coaxial with the developing roller and slightly larger in diameter than the developing roller, and the predetermined gap is always secured between the peripheral surface of the photosensitive drum and the peripheral surface of the developing roller, but a gap deviation between the peripheral surfaces of two rotating members is caused not by the peripheral surface itself, but by position deviations of the rotation shafts in two rotating members, and therefore the adjustment of the gap between both members by placing the gap setting member in sliding contact with the peripheral surface itself of the photosensitive drum cannot be said to be a direct way as a method of adjusting a gap fluctuation.

Moreover, the gap setting member is constituted by the bearing attached to the developing roller, and the outer race on the outer periphery of the gap setting member in sliding contact with the peripheral surface of the photosensitive drum is rotatable, but a part of the peripheral surface of the photosensitive drum is always in sliding contact with rotation in order to adjust the gap between both components, the peripheral surface edges are therefore worn, and as a result of long-time use a warp is generated between the peripheral surface on the center side of the photosensitive drum and the peripheral surface on the edge side in sliding contact with the gap setting member, which causes a problem that the gap between both components cannot accurately be adjusted.

Furthermore, for the position deviation of the peripheral surface between two rotating members having parallel rotation shafts, even when the gap adjustment is performed on one end side edge of the peripheral surface, with occurrence of a situation in which axial lines of the rotation shafts are not parallel to each other the constant gap can be maintained in the peripheral surface of one end side edge in sliding contact with the gap setting member, but the opposite peripheral surface in the other side edge is sometimes close to or apart from the predetermined gap, and it is difficult to maintain the predetermined gap over the entire area of the peripheral surface. To solve the problem it is also proposed to dispose the gap setting members on both ends of the developing roller, but even by a simple consideration two gap setting members are necessary, and the adjustment portion has to be also secured on the other edge opposite to the photosensitive drum, which therefore causes problems that manufacture cost increases and that a usable area of the photosensitive drum is narrowed.

SUMMARY OF THE INVENTION

The present invention has been developed to solve the aforementioned problems, and an object thereof is to provide an image forming system in which in order to adjust a gap between a photosensitive drum and a developing roller, instead of placing a gap setting member directly in sliding contact with a peripheral surface of the photosensitive drum, by allowing bearings of the photosensitive drum and developing roller to abut on each other to adjust the gap between both components in such a manner that a predetermined distance is maintained, gap adjustment is more precisely adjusted.

Another object is to provide an image forming system in which an accurate gap can be secured even after a long-time use without damaging the peripheral surface of the photosensitive drum in order to adjust the gap from the developing roller.

Further object of the present invention is to provide an image forming system which can accurately perform gap adjustment with respect the entire area of the peripheral surface without generating a gap fluctuation between both peripheral surfaces attributed to an axial line distortion or the like in two rotating members.

To achieve the aforementioned objects, according to a first basic constitution of the present invention there is provided an image forming system comprising: an image forming unit for forming an image by using a developing material; a medium supplying portion for supplying an image forming medium to the image forming unit; a medium conveying portion for conveying the supplied image forming medium; a medium supplying/conveying controller for controlling the supplying/conveying of the image forming medium to the image forming unit by the medium supplying portion and the medium conveying portion; a transferring portion for transferring the image developed by the image forming unit to the image forming medium; and a fixing portion for fixing the transferred image, wherein the image forming unit comprises: an image holding member for converting an optical image formed via an optical system into a latent image and subsequently depositing the developing material thereon to hold the image on an image holding surface, said image holding member being provided with a support shaft movably fixed to a main body frame of the system; a developing roller disposed in the developing portion for supplying the developing material to develop the latent image held on the image holding surface to the image with the developing material, and provided with a rotation drive shaft for supplying the developing material to the image holding surface; and a gap regulating mechanism which includes at least a first bearing for holding the support shaft of the image holding member, a gap setting portion, disposed at a predetermined distance from the first bearing in a direction of the image holding member, for holding the support shaft in the vicinity of the image holding member in an assisting manner, and a second bearing for rotatably holding the rotation drive shaft of the developing roller from the side of the developing portion and maintaining the distance between the image holding surface of the image holding member and the peripheral surface of the developing roller with the gap setting portion, and which sets a gap between two surfaces in such a manner that a constant fine gap is continued to be maintained between the gap setting portion and the second bearing.

In the image forming system according to the aforementioned first basic constitution, the gap regulating mechanism of the image forming unit according to a first middle constitution may be provided with: the first bearing and the gap setting portion laterally symmetrically disposed on both sides of the photosensitive drum as the image holding member; a coupling portion for coupling respective outer peripheral portions of the first bearing and gap setting portion; the second bearing having an outer peripheral surface opposite to the gap setting portion right close to both ends of the photosensitive drum via the outer periphery of the coupling portion and having its inner peripheral surface fitted into the rotation drive shaft of the developing roller; and an urging member for urging the developing roller in the direction of the image holding surface of the image holding member.

In the image forming system according to the first middle constitution, at least one of coupling members for coupling outer peripheral sides of the first bearing and the gap setting portion may be provided with a detail constitution by an elastic member for absorbing, by an elastic force, external action forces including deflection, distortion and eccentric action applied to the support shaft passed inside the diametric direction.

In the image forming system according to the detailed constitution, the elastic member may be formed of a thin member as compared with an ordinary coupling member, and elastically deformed to absorb the external action force when the external action force is applied around the support shaft to such an extent that the ordinary coupling member fails to be elastically deformed.

Moreover, in the image forming system according to the detailed constitution, the elastic member is constituted of a plurality of coupling pieces for bridging the first bearing and the gap setting portion, portions other than the plurality of coupling pieces are a plurality of openings which are lightened and opened, and the plurality of elastic pieces may be deformed to absorb the external action force when the external action force is applied around the support shaft to such an extent that the ordinary coupling member fails to be elastically deformed.

In the image forming system according to the first basic constitution, the gap regulating mechanism is provided with: the first bearing and the gap setting portion laterally symmetrically disposed on both sides of the photosensitive drum as the image holding member; a coupling portion for coupling respective outer peripheral portions of the first bearing and the gap setting portion; the second bearing having an outer peripheral surface opposite to the gap setting portion right close to both ends of the photosensitive drum via the outer periphery of the coupling portion and having its inner peripheral surface fitted into the rotation drive shaft of the developing roller; and an urging member for urging the developing roller in the direction of the image holding surface of the image holding member, and at least one of the first bearings may be formed by a positioning collar which is fitted into an attachment place of an image forming unit frame fixed on a main body side of the image forming system and which loosely supports the support shaft of the photosensitive drum inside the diametric direction to regulate a large displacement of the support shaft.

In the image forming system according to the first basic constitution, at least one of a pair of first bearings may be constituted by a bearing provided with an inner race into which the support shaft is fitted, an outer race which is fitted into the main body frame, and a ball sealed between the inner race and the outer race.

In the image forming system according to the first basic constitution, at least one of a pair of first bearings may be constituted by a sliding shaft bearing whose inner peripheral surface contacts the peripheral surface of the rotation drive shaft as the support shaft to support rotation of the rotation drive shaft.

In the image forming system according to the first basic constitution, at least one of a pair of gap setting portions may be constituted by a bearing provided with an inner race into which the support shaft is fitted, an outer race which is fitted into the main body frame, and a ball sealed between the inner race and the outer race.

In the image forming system according to the first basic constitution, at least one of the pair of gap setting portions may be constituted by a sliding shaft bearing whose inner peripheral surface contacts the peripheral surface of the rotation drive shaft as the support shaft to support rotation of the rotation drive shaft.

In the image forming system according to the first basic constitution, at least one of the pair of gap setting portions may be constituted by a fixing member, and one end of the fixing member abuts on the support shaft and the other end thereof abuts on the second bearing to set a gap between the image forming surface of the photosensitive drum supported by the support shaft and the outer surface of the developing roller.

In the image forming system according to the first basic constitution, the image forming unit is provided with a plurality of photosensitive drums as the image holding member, and a plurality of developing units as a developer for forming a pair with each of the photosensitive drums, at least the plurality of photosensitive drums are arranged in parallel in a tandem structure, and the plurality of photosensitive drums and a plurality of developing units may be assembled in one image forming unit case.

In the image forming system according to the first basic constitution, the image forming unit may have a transferring drum structure provided with a single photosensitive drum as the image holding member and a single developing roller as the developer.

In the image forming system according to the first basic constitution, the image forming unit may have an intermediate transferring structure provided with a single photosensitive drum as the image holding member, a plurality of developing rollers as the developer provided with different colors of developing materials disposed apart from one another via a predetermined angle around the photosensitive drum, and an intermediate transferrer for successively transferring the respective colors of developing materials formed on the photosensitive drum.

In the image forming system according to the first basic constitution, the image forming unit may have a multiple developing structure of one pass system which includes a single large-diameter photosensitive drum as the image holding member, and a plurality of developing rollers as the developer provided with different colors of developing materials apart from one another via a predetermined angle around the photosensitive drum, and which transfers a color image obtained by superposing the developing materials on the image holding surface of the photosensitive drum onto the sheet by passing the sheet as the image forming medium once to obtain the formed image.

In the image forming system according to the first basic constitution, the image forming unit may have a transferring drum structure which comprises at least a small-diameter rollershaped photosensitive member as the image holding member, a transferring drum provided with a large-diameter drum shape disposed on one side of the photosensitive member and the transferring portion on the peripheral surface of the drum shape, and a plurality of developing rollers for the respective developing materials disposed apart from one another via a constant angle on the peripheral surface of a large-diameter drum disposed on the other side of the photosensitive member, and which successively forms the images of the respective color developing materials on the image forming medium wound around the transferring drum to obtain a final color image.

In the image forming system according to the first basic constitution, the image forming unit may have a multiple rotation structure which comprises a large-diameter multiple-rotation photosensitive drum as the image holding member, and a plurality of developing rollers for the respective colors of developing materials disposed opposite to the image forming surface of the photosensitive drum and apart from one another by a predetermined angle, and which rotates the photosensitive drum multiple times to superpose the respective colors of developing materials on the image forming surface and then collectively transfers them to the image forming medium to obtain the color image.

According to a second basic constitution of the present invention there is provided an image forming system comprising: an image forming unit for forming an image by using a developing material; a medium supplying portion for supplying an image forming medium to the image forming unit; a medium conveying portion for conveying the supplied image forming medium; a medium supplying/conveying controller for controlling the supplying/conveying of the image forming medium to the image forming unit by the medium supplying portion and the medium conveying portion; a transferring portion for transferring the image developed by the image forming unit to the image forming medium; and a fixing portion for fixing the transferred image, wherein the image forming unit comprises: a photosensitive drum for converting an optical image formed via an optical system into a latent image and subsequently depositing the developing material thereon to hold the image on an image holding surface, said photosensitive drum being provided with a support shaft movably fixed to a main body frame of the system; a developing roller provided with a rotation drive shaft for supplying the developing material to the image holding surface to develop the latent image held on the image holding surface as the image by the developing material; and a gap regulating mechanism which includes at least first shaft holding means for holding the support shaft of the image holding member, gap setting means, disposed at a predetermined distance from the first shaft holding means in a direction of the image holding member, for holding the support shaft in the vicinity of the image holding member in an assisting manner, coupling means for coupling the first shaft holding means and an outer peripheral portion of the gap setting means, second shaft holding means for rotatably holding the rotation drive shaft of the developing roller from the side of the developing means and maintaining a distance between the image holding surface of the image holding member and the peripheral surface of the developing roller between the second shaft holding means itself and the gap setting means, said second shaft holding means being provided with an outer peripheral surface opposite to the gap setting means right close to both ends of the photosensitive drum via an outer periphery of the coupling means and an inner peripheral surface fitted into the rotation drive shaft of the developing roller, and urging means for urging the developing roller in the direction of the image holding surface of the image holding member, and which sets a gap between two surfaces in such a manner that the first shaft holding means and the gap setting means are laterally symmetrically disposed on both sides of the photosensitive drum and a constant fine gap continues to be maintained between the gap setting means and the second shaft holding means.

According to a third basic constitution of the present invention there is provided an image forming system comprising: image forming means for forming an image by using a developing material; medium supplying means for supplying an image forming medium to the image forming means; medium conveying means for conveying the supplied image forming medium; a medium supplying/conveying control means for controlling the supplying/conveying of the image forming medium to the image forming means by the medium supplying means and the image forming medium conveying means; transferring means for transferring the image developed by the image forming means to the image forming medium; and fixing means for fixing the transferred image, wherein the image forming means comprises: an image holding member for converting an optical image formed via an optical system into a latent image and subsequently depositing the developing material thereon to hold the image on an image holding surface, said image holding member being provided with a support shaft movably fixed to a main body frame of the system; a developing roller disposed in the developing means for supplying the developing material to develop the latent image held on the image holding surface to the image by the developing material, and provided with a rotation drive shaft for supplying the developing material to the image holding surface; and a gap regulating mechanism which includes at least first shaft holding means for holding the support shaft of the image holding member, gap setting means, disposed at a predetermined distance from the first shaft holding means in a direction of the image holding member, for holding the support shaft in the vicinity of the image holding member in an assisting manner, and second shaft holding means for rotatably holding the rotation drive shaft of the developing roller from the side of the developing means and maintaining the distance between the image holding surface of the image holding member and the peripheral surface of the developing roller with the gap setting means, and which sets a gap between two surfaces in such a manner that a constant fine gap continues to be maintained between the gap setting means and the second shaft holding means, the gap regulating mechanism comprises: coupling means for coupling the first shaft holding means and the gap setting means laterally symmetrically disposed on both sides of the photosensitive drum as the image holding member, and outer peripheral portions of the first shaft holding means and the gap setting means; the second shaft holding means provided with an outer peripheral surface opposite to the gap setting means right close to both ends of the photosensitive drum via an outer periphery of the coupling means and an inner peripheral surface fitted into the rotation drive shaft of the developing roller; and urging means for urging the developing roller in the direction of the image holding surface of the image holding member, and at least one of the first shaft holding means is formed by collar means which is fitted into an attachment place of the frame of the image forming unit fixed on a main body side of the image forming system and which loosely supports the support shaft of the photosensitive drum inside the diametric direction to position/regulate a large displacement alone of the support shaft.

DETAILED DESCRIPTION OF THE PREFERRED EMBODIMENTS

Preferred embodiments of an image forming system according to the present invention will be described hereinafter in detail with reference to the accompanying drawings.

Figure 1:
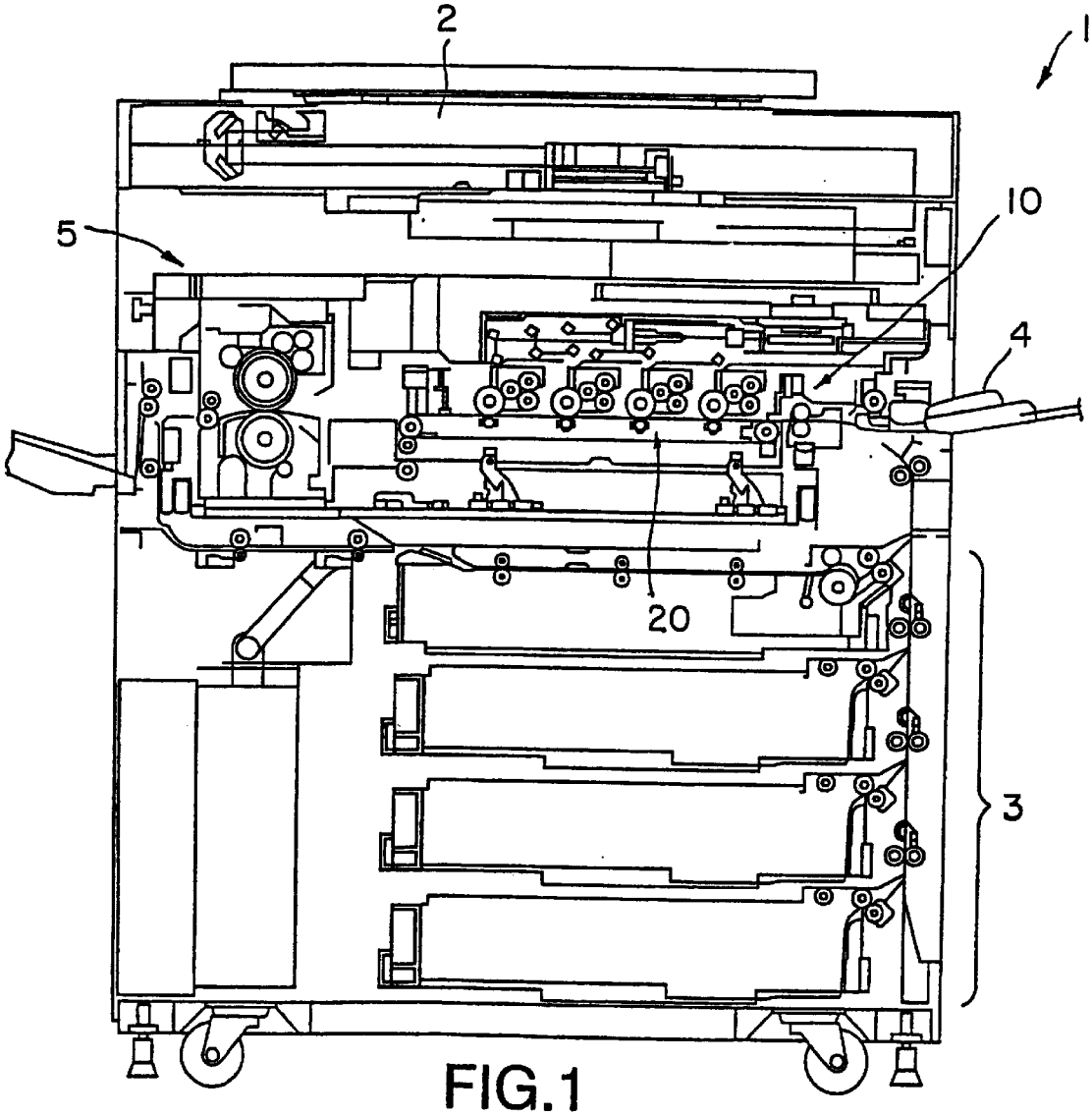
FIG. 1 is a sectional view showing a tandem type image forming system according to a first embodiment of the present invention.

FIG. 1 is a sectional view showing the entire constitution of the image forming system provided with a tandem type image forming unit as one example of the image forming system according to the present invention. In FIG. 1, an image forming system 1 is provided with: an image input portion 2, constituted, for example, of an optical system disposed on a top surface side of a main body, for reading a document; a sheet supply cassette device 3, disposed in a main body lower part, for containing a plurality of types of sheets to supply a large number of sheets with the same size; a manual insertion sheet supply device 4 by which various sizes or types of sheets can manually be supplied; an image forming unit 10 for converting an optical image formed by the image input portion 2 into a latent image to hold the image and for developing the held latent image by a developing material to form the image; a transferring unit 20 for transferring the formed image to a supplied sheet P; and a fixing unit 5 for fixing the transferred image.

Figure 2:
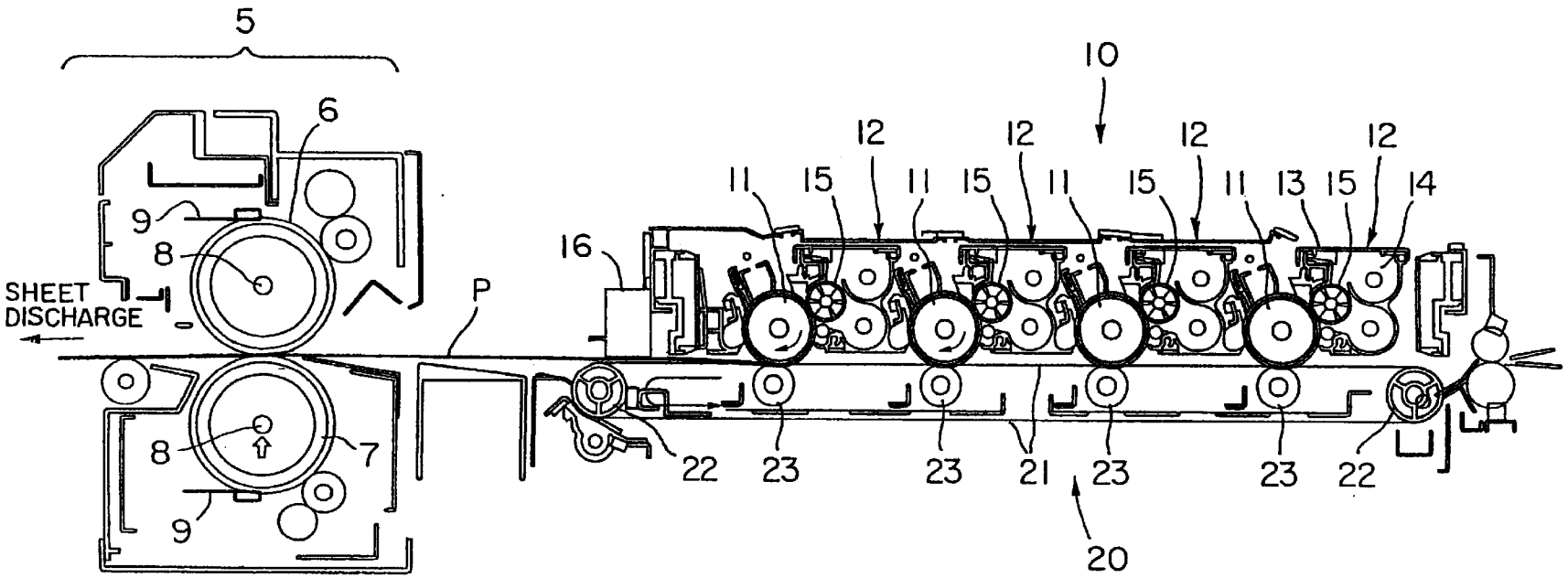
FIG. 2 is a sectional view showing a main part of the tandem type image forming system of FIG. 1 in an enlarged manner.

Since FIG. 1 only schematically shows the entire constitution of the image forming system, a detailed constitution of the image forming system will be described with reference to a main part enlarged view of FIG. 2. In FIG. 2, the image forming unit 10 constituted by applying the present invention to a tandem type copying machine comprises four pairs of basic structures in which four photosensitive drums 11 are combined with four developers 12, respectively, and the developer 12 is, as shown by reference numerals on a rightmost end, provided with: a developer case 13; a developing material containing portion 14, disposed in the case 13, for containing developing materials such as the toner; a developing roller 15 for supplying the toner as the developing material to the peripheral surface of the photosensitive drum 11 from the developing material containing portion 14; and a registration sensor 16 for detecting a color registration error when an image to be formed is recorded on the sheet P.

On a lower side of the image forming unit 10, a transferring unit 20 is disposed, and the transferring unit 20 is provided with a transferring belt 21 for transferring the image formed by an image forming device to the supplied sheet P and conveying the sheet P in an endless shape, a drive roller 22 for rotating/driving the transferring belt 21, and four transferring rollers 23 for transferring the image formed on the corresponding photosensitive drum to the sheet P. Additionally, in FIG. 2, the sheet P is supplied from the right side in the drawing and supplied/conveyed between the image forming unit 10 and the transferring unit 20 to a left direction in the drawing, and the sheet P is discharged as shown by an arrow after fixing.

The image transferred onto the sheet P by the image forming unit 10 and transferring unit 20 is supplied to the fixing unit 5 and fixed. The fixing unit 5 is provided with: an upper heat roller 6 which is heated and rotated/driven; a press roller 7 which is heated and rotated/driven and which presses the sheet P against the heat roller 6; a heat lamp 8, disposed inside the heat roller 6 and press roller 7, for heating these rollers 6 and 7; and a temperature detecting sensor 9 for detecting temperatures of the rollers 6 and 7.

Figure 3:
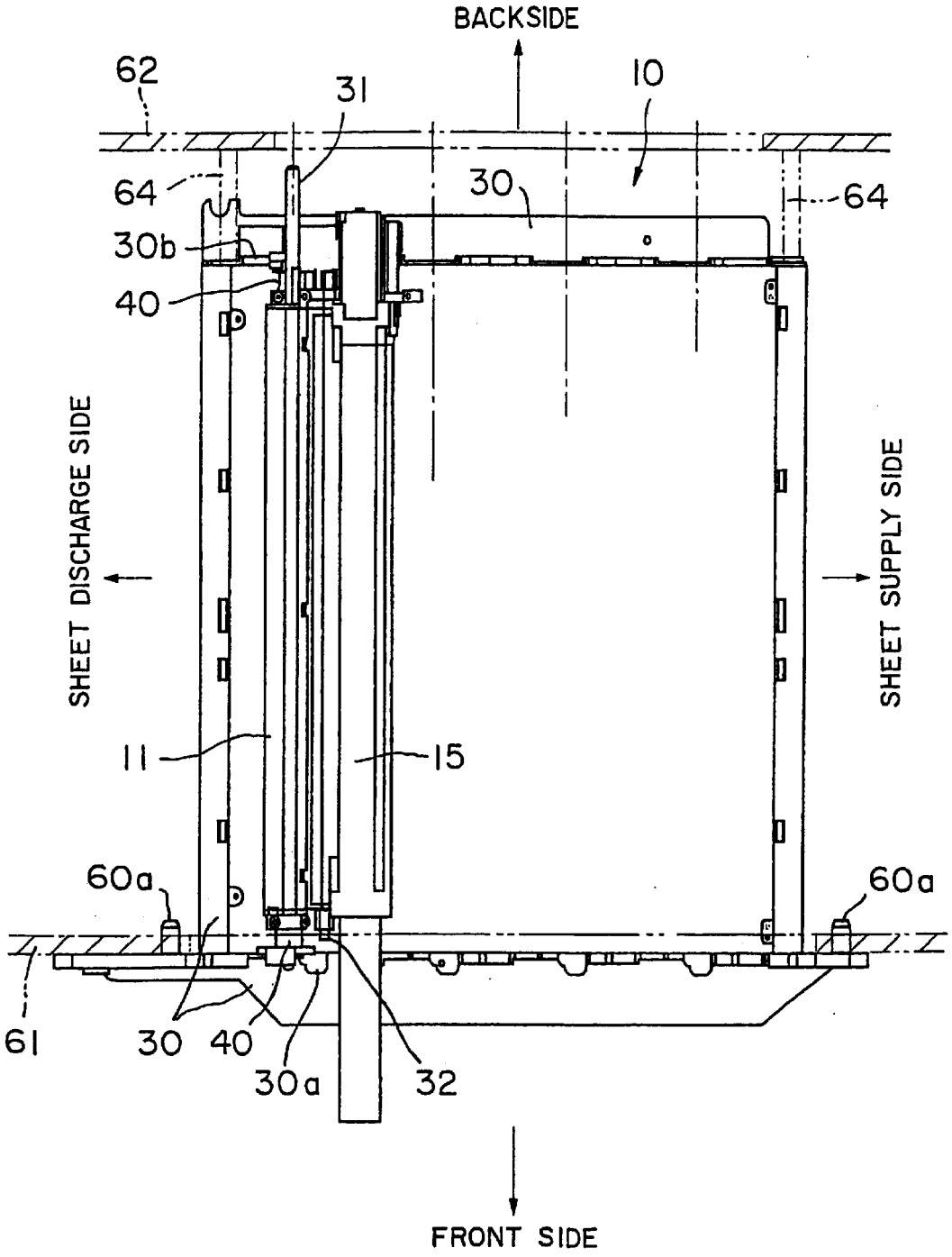
FIG. 3 is a plan view showing a position relation between a photosensitive drum and a developing roller of the image forming system according to the first embodiment.

FIG. 3 shows a plan view of the image forming unit 10, and for convenience of description the drawing shows only a pair of the photosensitive drum 11 and developing roller 15 positioned closest to a discharge side among four photosensitive drums 11 and four developing rollers 15 constituting the image forming unit 10. The image forming unit 10 comprises a housing frame 30 for incorporating four pairs of photosensitive drums 11 and developing rollers 15, and the photosensitive drum 11 and developing roller 15 are attached to a predetermined position f the frame 30. A rotation drive shaft 31 of the photosensitive drum 11 and a rotation drive shaft 32 of the developing roller 15 are rotatably supported on the side of the frame 30 by a gap regulating mechanism 33 which also serves as a bearing and are constituted in such a manner that a fine gap is always maintained as an equal distance between the peripheral surface of the photosensitive drum 11 and the peripheral surface of the developing roller 15.

Figure 4:
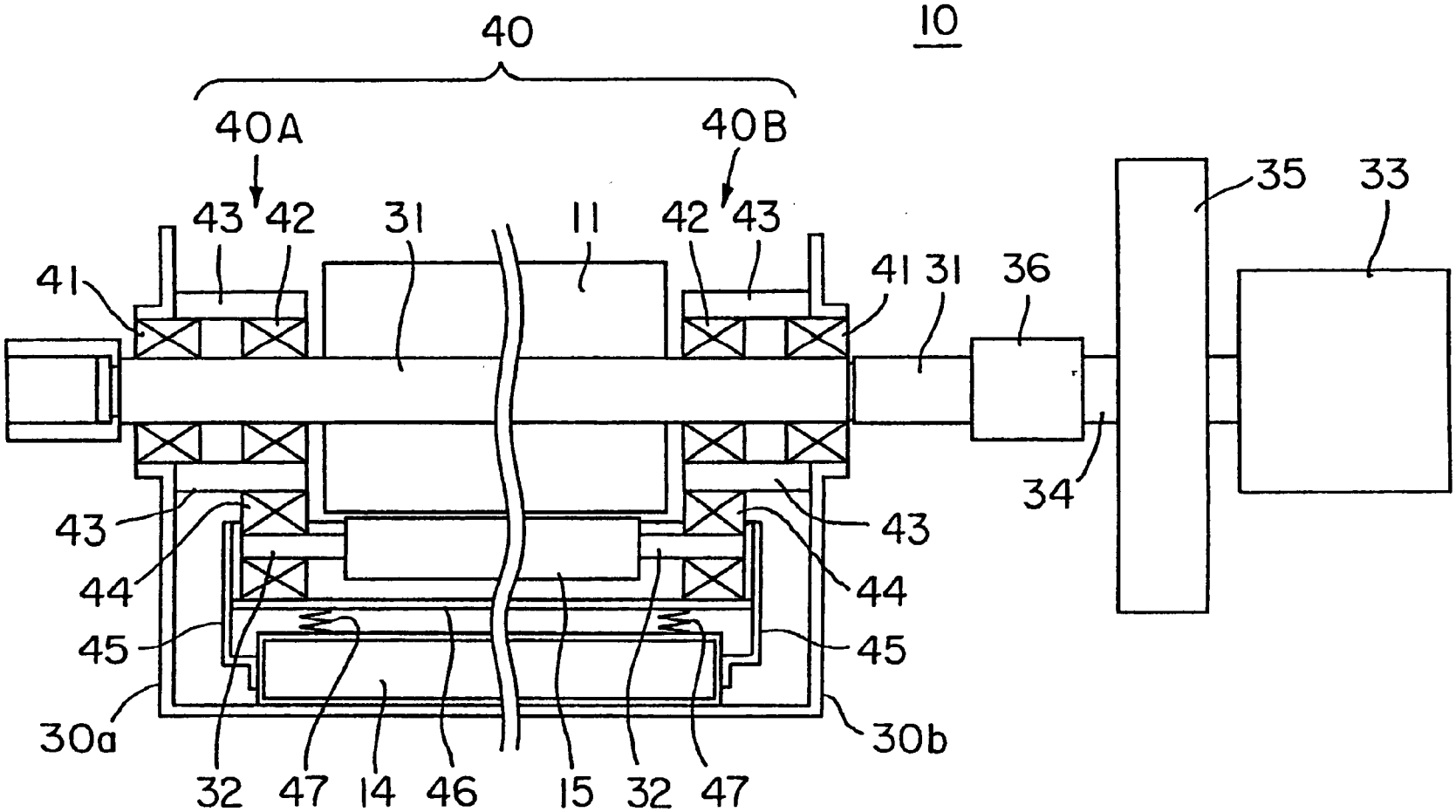
FIG. 4 is a sectional view showing a simplified model of a gap regulating mechanism disposed on a bearing portion of the photosensitive drum and developing roller of an image forming unit according to the first embodiment.

With reference to FIG. 4 showing a simplified model of a bearing structure according to the present embodiment in addition to FIG. 3, a detailed constitution of the gap regulating mechanism 40 will be described. Additionally, in the subsequent description, an upper side of FIG. 3 is sometimes referred to as a rear side, a lower side thereof is a front side, a right side thereof is a sheet supply side, and a left side thereof is a sheet discharge side. FIG. 4 is a view of the sheet discharge side as seen from the sheet supply side, and in FIG. 4 the right side is the rear side and the left side is the front side.

In FIG. 4, the image forming unit 10 is detachably attached to raised surfaces 30*a*, 30*b* (corresponding to 61, 62 in FIG. 12) forward and backward in the housing-shaped frame as an attachment main body. Along a rail guide disposed to connect the front surface to the back surface of the main housing frame, left and right side stays of the frame on the side of the image forming unit 10 slide, and movement of the image forming unit is guided during attachment/detachment. This constitution will be described later in details as a third embodiment with reference to FIGS. 12 to 14.

In order to position the image forming unit attached to the main body, positioning portions (described later as a stud or an insertion hole together with front and rear side frames 61, 62 in FIG. 12) are disposed on the raised surfaces 30*a*, 30*b* forward and backward in the frame 30 of the image forming unit 10, and a corresponding constituting portion (hole or stud) is formed in a corresponding position of the main body housing frame. This stud has a sufficient length to function as a guide when a type of a shaft extended from the rear of the image forming unit described later or another main body bonding site is bonded to a corresponding main body bonding site. The stud is screwed to a main body front frame from the front side not to be detached after the image forming unit is attached to the main body.

On the raised surface 30*b* on the back surface side of the main body frame, a drum drive motor 33, a power transmission shaft 34 for transmitting a power from the motor 33 to the side of the photosensitive drum 11, a flywheel 35 attached to the transmission shaft 34, and a power supply terminal (not shown) for giving a charging voltage are disposed, and the transmission shaft 34 is provided with a bond coupling 36 for connecting the rotation drive shaft 31 of the photosensitive drum to a tip end thereof. Illustration or description is omitted with respect to a periphery of a drive shaft of a developing roller drive motor but a constitution similar to a constitution for use in rotating/driving the photosensitive drum 11 is disposed, and a voltage supply terminal for each site necessary for an image forming process is further disposed. Also on the side of the image forming unit 10, a drum shaft, developing drive transmission shaft and power supply terminal are disposed in corresponding positions during attachment. When the image forming unit 10 is attached to the raised surfaces 61, 62 of the main body side frame 30, the drum shaft, developing drive shaft and power supply terminal are all in an integral state on the side of the main body and image forming unit.

Figure 5:
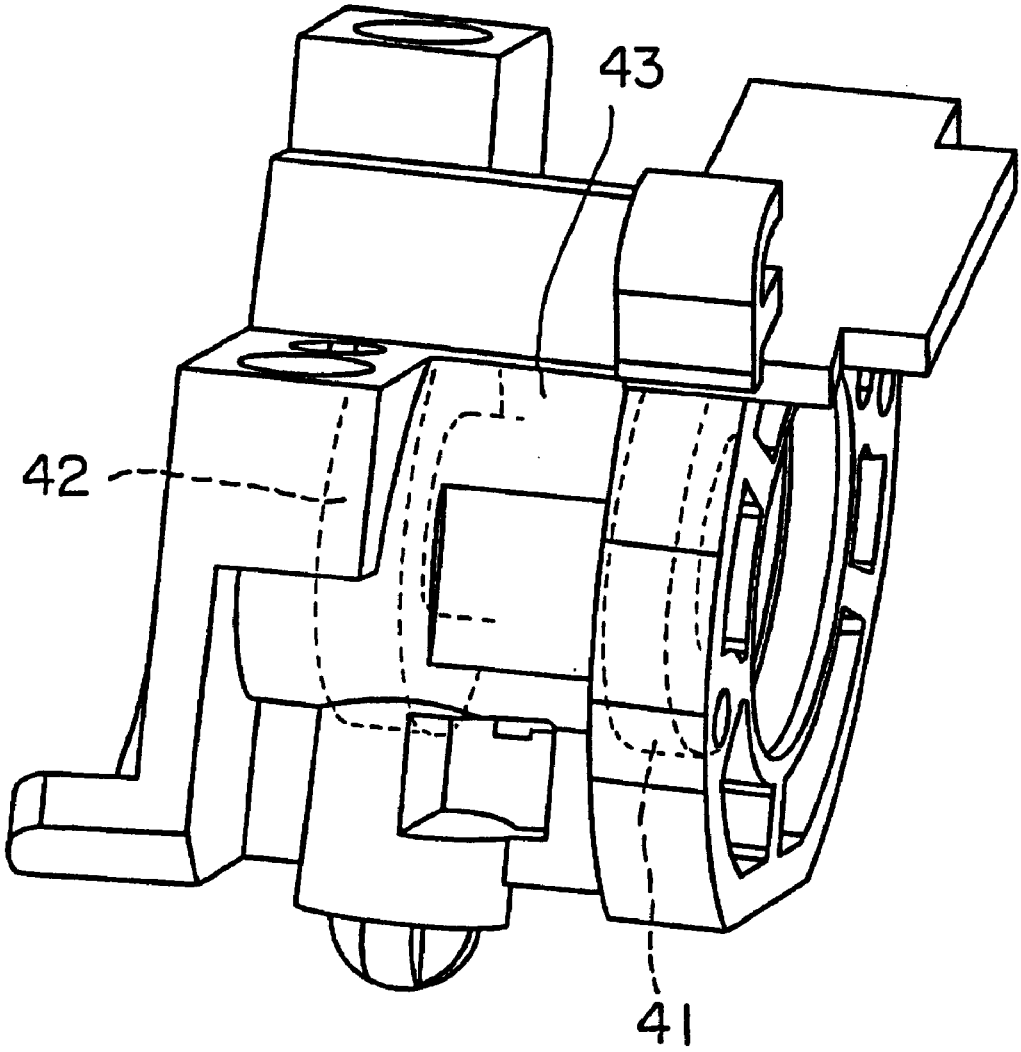
FIG. 5 is a perspective view showing a constitution of the gap regulating mechanism on a rear side in the image forming unit shown in FIG. 4.

FIG. 5 is a perspective view showing a constitution of the gap regulating mechanism on a photosensitive drum side of the image forming system according to the first embodiment, a first bearing 41 is fixed to the housing frame whose main body side is shown on the right side of the drawing, and a gap setting portion 42 disposed in a position apart from the first bearing 41 at a constant position is fixed to the rotation drive shaft (not shown in FIG. 5) of the photosensitive drum. A coupling portion 43 is disposed between the first bearing 41 and the gap setting portion 42 to bridge both components. In this constitution the rotation drive shaft of the photosensitive drum is rotatably supported basically by the first bearing 41 on the main body side housing frame, the distance from the developing roller is adjusted by the second bearing 42 to be constant, and the fine gap between the outer peripheral surfaces of both components can always be set to a constant distance.

Figure 6:
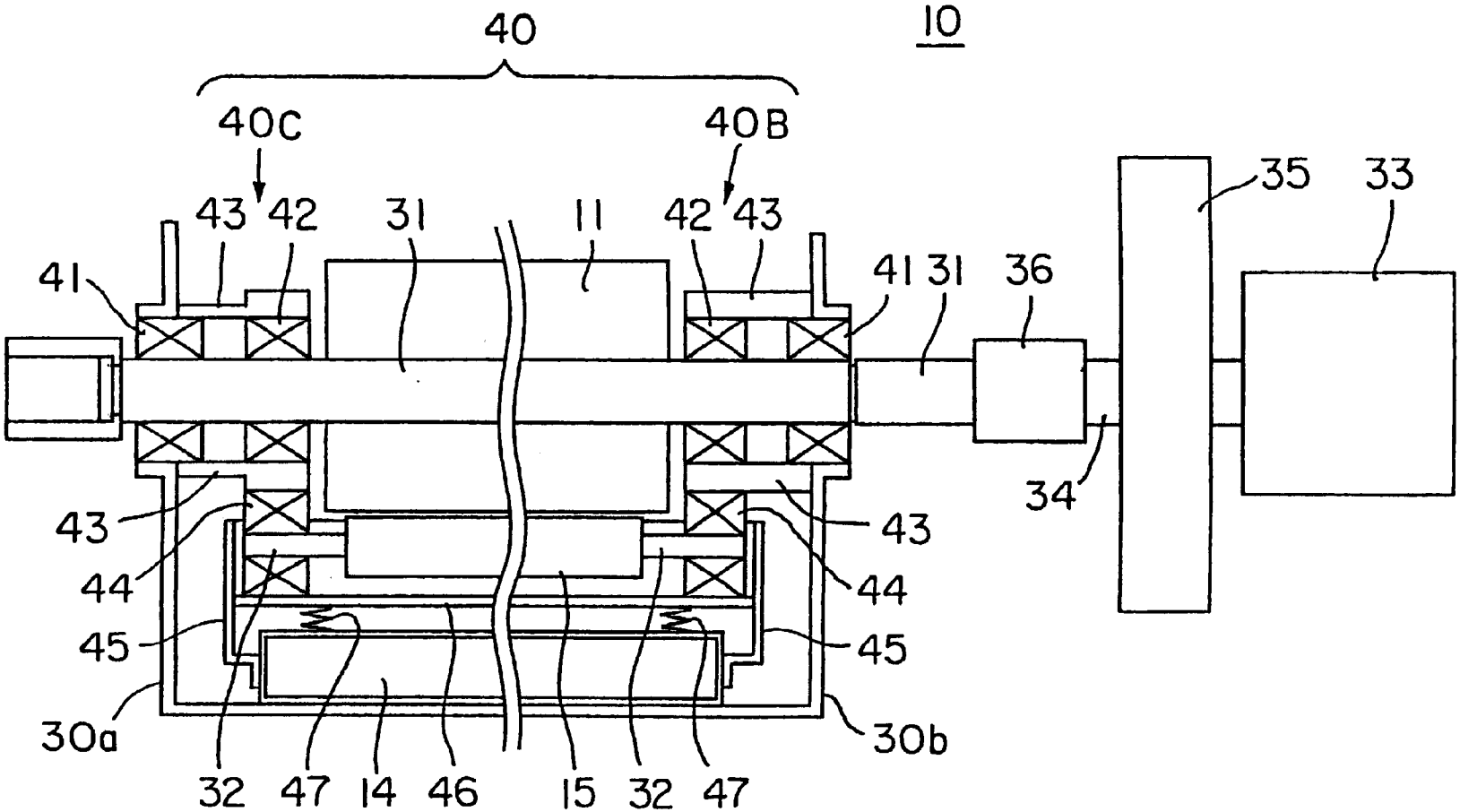
FIG. 6 is a sectional view showing a simplified model of the image forming unit whose coupling portion is thinned as a modification example of FIG. 4.

FIG. 6 is a sectional view showing a simplified model of the image forming unit in which the coupling portion 43 is thinned as a modification example of FIG. 4. In FIG. 6, only the coupling portion 43 of a front side gap regulating mechanism 40C has a thin shape, but the present invention is not limited to this and such modification may be added to a rear side gap regulating mechanism 40B.

Figure 7:
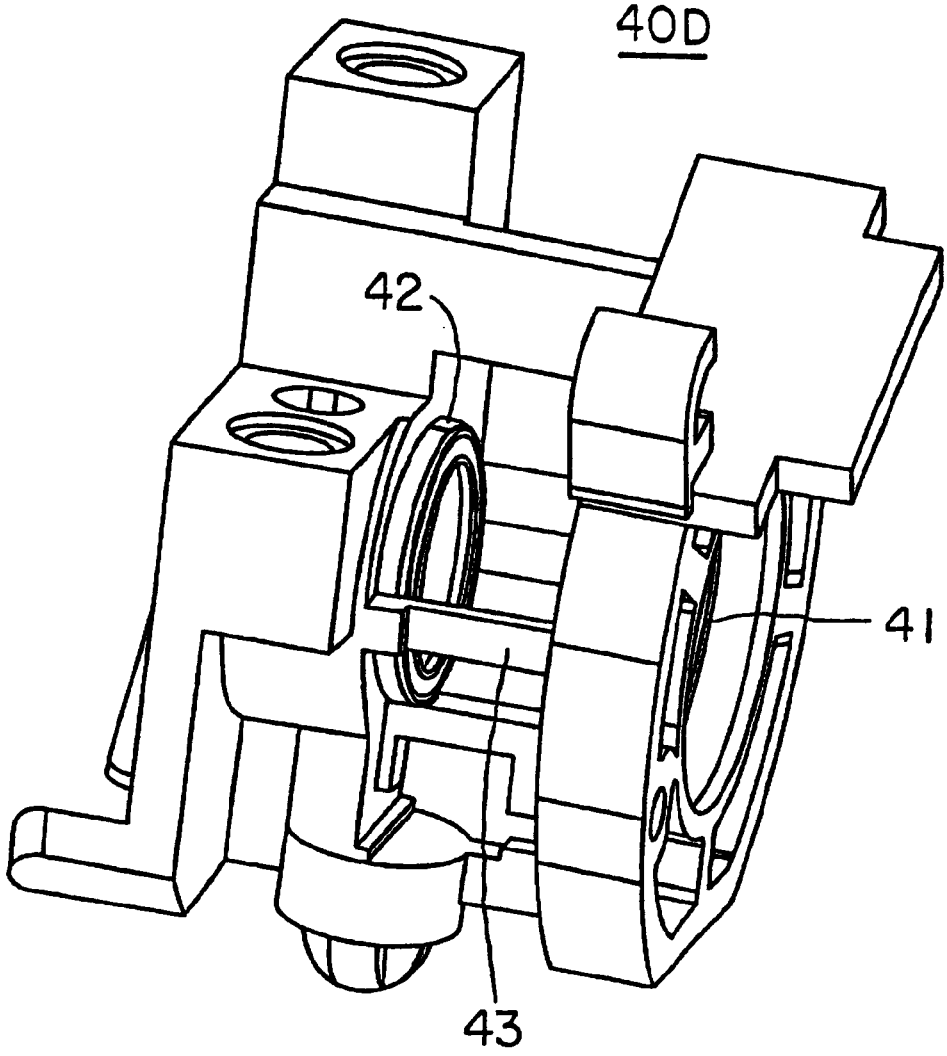
FIG. 7 is a perspective view showing a constitution of the image forming unit whose coupling portion is lightened as a modification example of FIG. 5.

FIG. 7 is a perspective view showing a constitution of further modification example of the gap regulating mechanism according to the first embodiment. In the modification example of FIG. 7, the coupling portion 43 in the middle of an extended portion of a drum holder 40D is placed in a lightened state, and structured to be further easily elastically deformed. When the drum holder 40D is integrally formed on a metal plate frame of the image forming unit 10, as a modification example of the second embodiment shown in FIG. 9D described later, a flange 37 is formed as a bearing holding portion connected via a thin piece bent in a V shape or a two-bend crank shape, and in an easily plastically deformed constitution by respective bent portions a follow-up (copy) property of the bearing 41 with respect to the rotation drive shaft 31 becomes satisfactory.

In the structure in which the follow-up property is enhanced by the modification, a holding distance of the rotation drive shaft 31 can be set to be long, positioning of the rotation drive shaft 31 of the photosensitive drum 11 is securely performed, but a perpendicular degree with respect to the rotation drive shaft is also satisfactorily maintained, holding of a portion necessary for gap management is provided with softness, the copy property can be enhanced, and a stress of error of the holding portion applied to the rotation drive shaft can considerably be reduced in the structure.

The inside of the image forming unit will next be described. The forward and backward drum holder 40 as the gap regulating mechanism is screwed/fixed to the image forming unit frame. The drum holder 40 is provided with: the first bearings 41, 41 for holding the rotation drive shaft 31 of the photosensitive drum 11 on the frame raised surfaces 30*a*, 30*b*; the gap setting portion bearings 42, 42 for holding the shaft in positions closest to both end surfaces of the photosensitive drum 11; the coupling members 43 for connecting a pair of first and gap setting portion bearings 41, 42 on the respective sides of the frame raised surfaces 30*a*, 30*b*; second bearings 44 for holding the rotation drive shaft 32 of the developing roller 15 on both sides of the developing roller 15 and abutting on the peripheral surface of the coupling member 42 by its outer peripheral surface to set a gap between the photosensitive drum 11 and the developing roller in such a manner that the fine gap is formed between the peripheral surfaces of the drum and roller; and levers or brackets 45 for supporting the bearing on the side of the developing roller 15 from the developer case main body 14. Additionally, the second bearings 44, 44 disposed on both ends are provided with a support plate 46 for bridging both components, and urging members 47, 47 for urging the support plate 46 and developing roller 15 in a direction of the photosensitive drum 11 are disposed between the developer main body case 14 and the support plate 46.

Illustration and detailed description are omitted, but the first bearing and gap setting portion bearings 41, 42 are constituted of an inner race fixed to the shaft 31 of the photosensitive drum 11, an outer race fixed to the frame raised surfaces 30*a*, 30*b* and coupling member 43, and a rotatable ball sealed between the inner race and the outer race. Moreover, the second bearing 44 is constituted of the inner race fixed to the rotation drive shaft 32 of the developing roller, the outer race fixed to the support plate 46, the outer race fixed to the support plate 46, and the rotatable ball pressed between the inner race and the outer race.

Additionally, in the description of the aforementioned first embodiment, as the concrete constitution of the gap regulating mechanism 40 the use of bearings as the first and second bearings and the gap setting portion has been described, but the present invention is not limited to this and the concrete constitution of the gap regulating mechanism 40 may be a bearing structure other than a ball bearing, for example, an oil containing metal bearing or a sliding shaft bearing using plastic with a high sliding property.

Returning to the description with reference to FIG. 4, for the photosensitive drum 11 as the image holding member, while a drum main body is tentatively placed in the image forming unit, the drum shaft 31 is passed from the side of the raised surface 30*a* on the front side of the frame 30 through a gap regulating mechanism 40A on the front side, main body of the photosensitive drum 11, and the gap regulating mechanism 40B on the back side and fitted into the coupling 36 fixed to the tip end of the output shaft 34 of the motor 33 disposed on the main body side, so that the image forming unit 10 is completed.

A protruded portion is partially formed on a front flange hole of the photosensitive drum 11, and a groove for engaging with the portion is formed in the front part of the drum shaft 31, which forms a constitution to drive the main body of the drum 11 with the drum shaft 31.

For the developing unit 12, for arrangement along the peripheral surface of the photosensitive drum 11, the developing unit 13 is screwed/fixed on a frame side, that is, a drum holder top surface in order to facilitate a fixing operation in this embodiment.

In the developing unit 12, the developing material is supplied from a supply cartridge portion (not shown), stirred by a screw-shaped auger (not shown) in the developing unit 12 and charged before the developing material is supplied to the developing roller (magnet roller) 15 disposed adjacent to the unit. In the developing roller 15, a magnetic field is applied to the developing material supplied/attached to a developing roller sleeve with a magnetic roller built therein, and a magnetic carrier contained in the developing material forms a magnetic brush state. When the developing roller sleeve on the outer periphery rotates, a magnetic brush supplies the developing material to the drum surface in the structure.

The developing roller 12 can freely rotate within a range limited by the structure via the lever 45 rotatably supported by the developing unit, and urged to the side of the photosensitive drum 11 by the spring member 47. Moreover, a doctor blade assembled together with the rotatable developing roller 15 and lever assembly block 45 regulates a height to be thin when the magnetic brush stands like ears of rice, and the developing material is supplied to the peripheral surface of the photosensitive drum 11 in the structure.

Therefore, in order to obtain a good-quality image, between the peripheral surface of the photosensitive drum 11 and the peripheral surface of the developing roller 15, the fine gap needs to be maintained in accordance with an image forming process property. In a conventional case, as described above, on either one of both sides of the rotatable developing roller disposed along the photosensitive drum side (either one of forward and backward sides of the device in an attached state to the image forming device), a contact roller coaxial with a developing roller axis is disposed. Thereby, after the developing unit and photosensitive drum are assembled in the image forming unit, the contact roller disposed opposite to a portion deviating from an image forming area on the peripheral surface of the photosensitive drum abuts on the photosensitive drum and rotates with rotation of the photosensitive drum and developing roller, a distance between the outer peripheral surface of the photosensitive drum and the shaft of the developing roller is regulated, and the aforementioned gap between both peripheral surfaces is thereby maintained/managed in the structure.

In this conventional gap maintenance/adjustment, since the contact roller directly abuts on the outer peripheral surface of the photosensitive drum, external force disturbance in this abutment portion is immediately applied to the outer peripheral surface of the photosensitive drum. Even for impacts such as image quality deterioration which raise no problem in monochromatic printing, in color printing in which multi-color images are superposed, even a slight disturbance sometimes influences a hue, and as a result, jitter or color unevenness sometimes appears on the image formed on the sheet.

In the present invention, in order to solve the problem the maintenance/management of the gap between the photosensitive drum and the developing roller is not adjusted by direct abutment onto the peripheral surface, and as shown in FIG. 4, the adjustment is performed by the gap regulating mechanism disposed on the bearing of the photosensitive drum and the bearing of the developing roller.

Moreover, during the conventional gap adjustment between the peripheral surfaces of the photosensitive drum and developing roller, because of direct contact with the drum surface, the drum surface is shaved by long-time continuous use. The shaved site has no influence on image formation itself, but a part of the peripheral surface of the photosensitive drum is shaved, and as a result the gap is gradually narrowed. The photosensitive drum has a life by a photosensitive layer thickness, and in many cases changed before shaved to provide an inappropriate gap, no substantial large problem is raised, but in recent years, the life has been lengthened by improvement of the photosensitive drum, and a problem may possibly arise in future.

An inventive gap maintenance/management structure proposed by the present invention is constituted as follows. First, as shown in FIG. 4, separately from the first bearings 41, 41 disposed on the main body side frame 30 to hold rotation of the rotation drive shaft 31 of the photosensitive drum 11, the gap setting portion bearings 42, 42 are disposed in the vicinity of the photosensitive drum 11, and on the front and back sides of the main body the first bearing 41 is connected to the gap setting portion 42 by the coupling member 43. The outer surfaces of the coupling members 43, 43 abut on the outer peripheral surface of the outer race of the second bearing 44 for holding the rotation of the developing roller 15, and this indirectly maintains the gap between the outer peripheral surface of the photosensitive drum 11 and the outer peripheral surface of the developing roller 15 at a predetermined gap.

In the present specification, for the sake of convenience the gap regulating mechanism 40 is also referred to as the drum holder, but the drum holder is characterized in that the holder is extended in an inner shaft direction to the vicinity of the flange of the photosensitive drum 11 and that the gap is indirectly regulated by the gap setting portion bearing 42 disposed on the extended site.

The gap setting portion bearing 42 holds the rotation drive shaft 31 in the vicinity of the photosensitive drum, and has a function of following the position of the shaft 31 and indirectly regulating the shaft position on the outer surface of the extended site of the drum holder 40. Specifically, a position obtained by subtracting "thickness+bearing radius" from the outer surface of the drum holder 40 corresponds to a drum shaft center, the thickness of the drum holder 40 is set to obtain a relation represented by an equation:

target gap length={(drum holder thickness+drum holder side bearing radius)+contact roller radius}−{drum outer periphery radius+developing roller radius}, the contact roller formed by the second bearing 44 is placed in contact with the outer surface of the holder 40 of the photosensitive drum 11, and the gap is managed/maintained.

Figure 8:
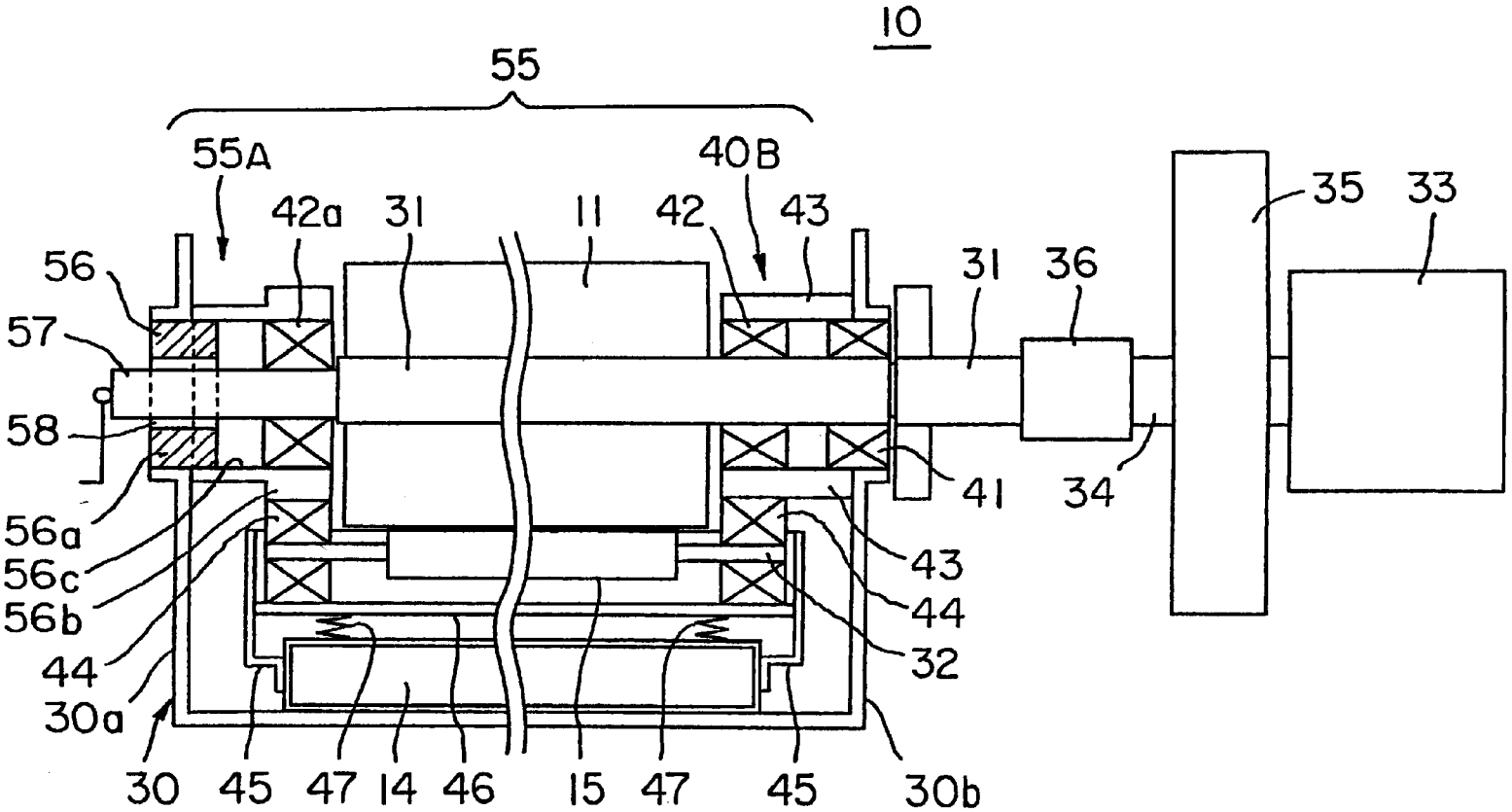
FIG. 8 is a sectional view showing a simplified model of the gap regulating mechanism in the image forming system according to a second embodiment of the present invention.

Additionally, in the image forming system according to the aforementioned first embodiment, the constituting of all the first and second bearings and gap setting portion forming the gap regulating mechanism 40 by the ball bearings has been described, but the present invention is not limited to this, and these bearings and gap setting portion may be constituted by sliding bearings. FIG. 8 is a sectional view showing the gap regulating mechanism in the image forming system according to the second embodiment of the present invention. As shown in FIG. 8, for either one of forward and backward drum holders, the first and second bearings 41, 42 of the drum holder 40B on the back side in the example shown in the drawing mainly hold the rotation drive shaft 31 of the photosensitive drum 11, the position of the rotation drive shaft 31 of the photosensitive drum 11 and the perpendicular degree with respect to the main body side housing frame 30 are determined, in another drum holder 55A only the second bearing 42 for gap management holds the rotation drive shaft 31, and both side second bearings 42, 42*a* for the gap management manage/regulates the gap between the outer peripheral surface of the photosensitive drum 11 and the outer peripheral surface of the developing roller 15.

A detailed constitution of the gap regulating mechanism according to the second embodiment will be described with reference to FIG. 8. Since the constitution of the drum holder 40B on the main body rear side is the same as the constitution of the first embodiment described using FIG. 4, the same reference numerals are used and a detailed description is omitted. The drum holder 55A on the front side of the main body is provided with the bearing 42*a* of substantially the same constitution as that of the gap setting portion bearing 42 of the drum holder 40B, and a positioning collar 56 disposed opposite to the bearing 42*a,* fitted into the flange of the front side raised surface 30*a* of the frame 30 and also connected to the bearing 42*a*.

In the second embodiment shown in FIG. 8, the positioning collar 56 is provided with a fixing portion 56*a* engaging with the flange of the raised surface 30*a* of the frame 30, a bearing holding portion 56*b,* disposed opposite to the photosensitive drum 11, for holding the bearing 42*a,* and a thin bridge portion 56*c* for bridging the fixing portion 56*a* and holding portion 56*b*. On the main body front side of the rotation drive shaft 31 of the photosensitive drum 11 a small diameter portion 57 is formed with a small diameter, and a center hole 58 formed on the center side of fixing portion 56*a* of the collar 56 is in a loose engagement state with the small-diameter portion 57.

According to the holding structure of the photosensitive drum in the image forming unit according to the second embodiment constituted as described above, by removing the positioning bearing of the rotation drive shaft 31 of the photosensitive drum 11 of one drum holder 55A, and lowering a sliding function by the ball bearing, the stress attributed to an error from a coaxial degree of the bearing 42 and applied to the rotation drive shaft of the photosensitive drum can be weakened.

Figure 9D:
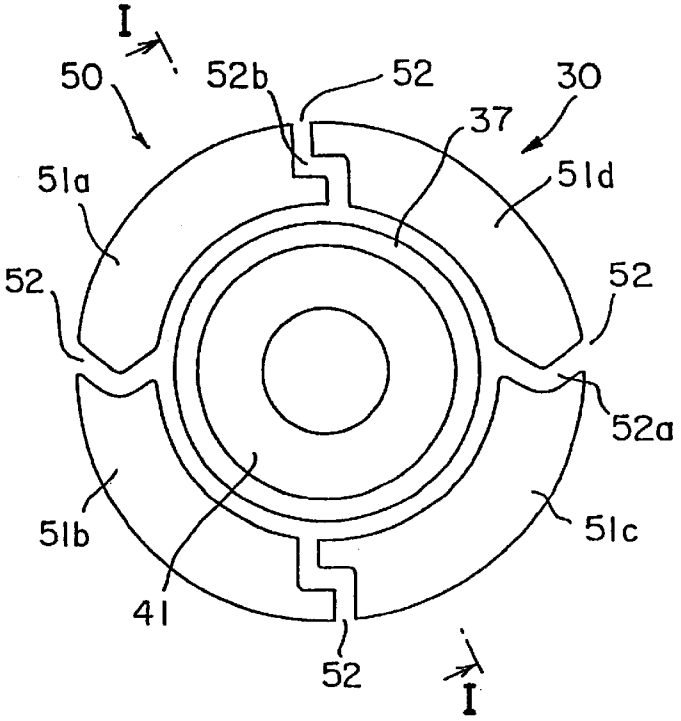
FIGS. 9C and 9D are a sectional view and a front view showing the attachment structure of the photosensitive drum bearing to the frame using plastic deformation as a modification example.
Figure 9C:
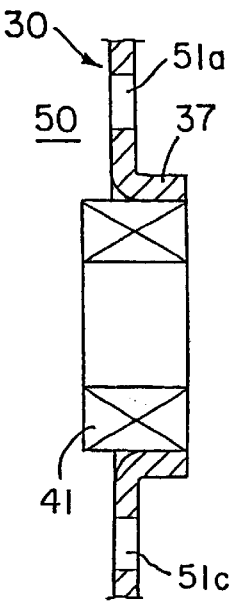
Figure 9B:
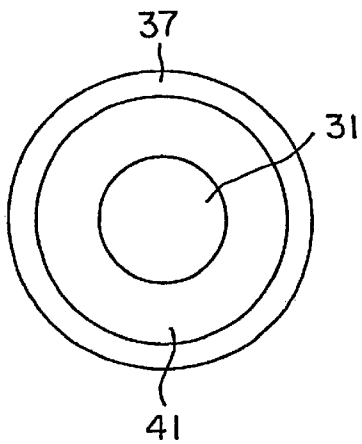
FIGS. 9A and 9B are a sectional view and front view showing an attachment structure of an ordinary photosensitive drum bearing of FIG. 8 to a frame.
Figure 9A:
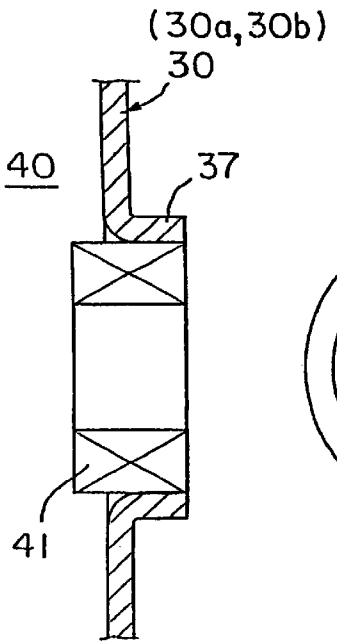

FIGS. 9A and 9B are a sectional view and front view showing details of the bearing structure of the photosensitive drum. The first bearing 41 constituting the drum holder 40 engages in the flange 37 disposed on the main body side housing frame 30. When the first bearing 41 is constituted, for example, by the bearing, the outer race is fitted/fixed with the inner wall of the flange 37, and on the center side of the inner race the rotation drive shaft 31 of the photosensitive drum is fitted/fixed in the structure.

Additionally, one characteristic of the constitution in which the drum holder 40 according to the present invention is used as the bearing on both ends of the front and back sides of the photosensitive drum 11 lies in that, for example, distortion or the like of the rotation drive shaft 31 during assembling of the photosensitive drum 11 to the image forming unit can be absorbed. Specifically, the rotation drive shaft 31 of the photosensitive drum 11 is supported at two points only by the main body side frame, while in the present invention at least the first and gap setting portion is disposed on both sides of the photosensitive drum 11 in the constitution, so that the distortion or the like of the rotation drive shaft 31 during attachment can be absorbed.

FIGS. 9C and 9D are a sectional view and a front view showing the attachment structure of the photosensitive drum bearing to the frame using plastic deformation as a modification example of FIGS. 9A and 9B. A displacement absorbing portion 50 is disposed around the flange 37 of the frame 30, and this displacement absorbing portion 50 is provided with four ¼ peripheral hole portions 51*a* to 51*d* and four coupling pieces 52 of various shapes described later.

Additionally, after the photosensitive drum 11 is assembled into one with the developing unit to constitute the image forming unit 10, during attaching to the main body side the outer peripheral portion of the bearing portion of the photosensitive drum 11 is distorted with the corresponding portion on the main body side or sometimes impacted. As a constitution for absorbing such damage to the bearing portion, a constitution shown in FIG. 9D may be disposed. The displacement absorbing portion 50 for the unit frame of the image forming unit 10 shown in FIG. 9D is disposed to surround the flange 37 on the outer peripheral side of the flange 37 of the unit frame molded by synthetic resins such as plastic. As shown in FIG. 9D, in the displacement absorbing portion 50, for example, the ¼ peripheral portions 51*a*, 51*b*, 51*c*, 51*d* are formed around the flange 37 of the frame 30 by integral molding. The notch portion 52 of a predetermined shape is formed between respective edges of the peripheral portions 51*a* to 51*d*. As a concrete shape of the notch portion 52, there are a V-shaped notch portion 52*a* and a crank-shaped notch portion 52*b*, and either notch portion absorbs displacement by distortion of the rotation drive shaft 31 of the photosensitive drum during assembly or disassembly.

As described above, for the gap setting portion bearings 42, 42 on the side of the photosensitive drum 11 in the drum holder 40 for the gap management, the holder disposed the forward and backward sides in the main body instead of only one side is constituted of a pair of 40A, 40B, and by constituting a pair of second bearings 44, 44 opposite to the gap setting portion bearing 42 via the coupling member 43, gap management with a higher precision is possible.

Additionally, in the structure of the first embodiment, the holding of the rotation drive shaft 31 of the photosensitive drum 11 is performed by four bearings 41, 42, 41, 42 exceeding two bearings, and by the necessarily generated coaxial degree error between the bearings, not little stress of the diametric direction sometimes occurs in the drum shaft 31. This stress results in a motor drive load, and there is a problem that rotation precision is deteriorated.

Therefore, in order to also solve this problem, a new structure for obtaining a satisfactory follow-up property of the drum holder 40 in the direction of the photosensitive drum 11 with respect to a position fluctuation of the extended portion in a radius direction of the rotation drive shaft 31 is provided as the second embodiment.

Figure 10:
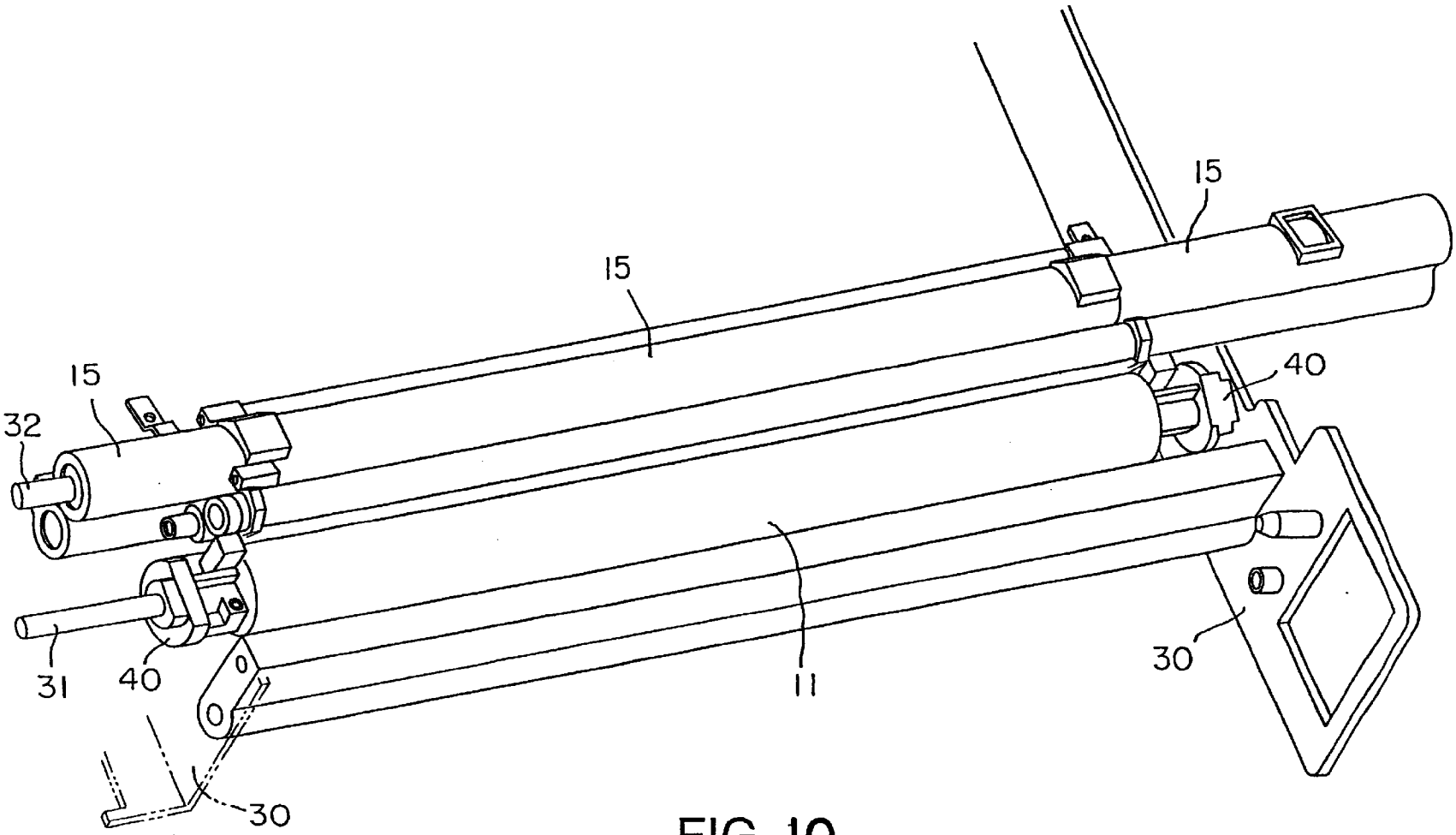
FIG. 10 is a perspective view showing an appearance constitution of the gap regulating mechanism according to the second embodiment shown in FIG. 8.

FIG. 10 is a perspective view showing attachment positions of the photosensitive drum and developing roller. FIG. 10 does not show a particularly new constitution, and shows the assembly position of the photosensitive drum 11 and developing roller 15 to the main body side housing frame 30. In FIG. 10, between the rotation drive shaft 31 of the photosensitive drum 11 and the rotation drive shaft 32 of the developing roller 15, the drum holders 40 as the gap regulating mechanism are disposed on both ends (the front and back sides in a main body position relation).

Figure 11:
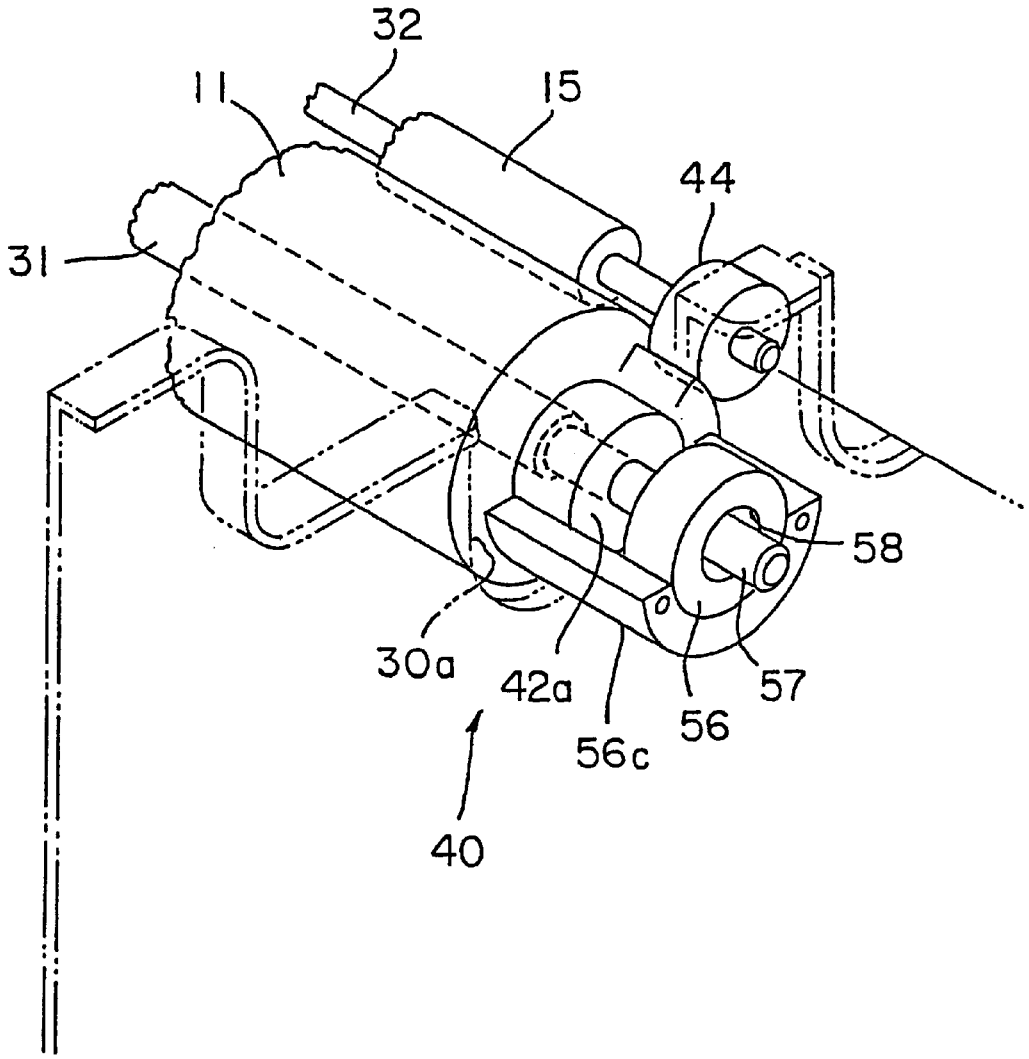
FIG. 11 is a perspective view showing an appearance of the gap regulating mechanism in the image forming system of the second embodiment.

FIG. 11 is a perspective view showing details of the gap regulating mechanism in the image forming system of the second embodiment. FIG. 11 shows one side of the drum holder 40 shown in FIG. 4 in a cutaway manner. In FIG. 11, the rotation drive shaft 31 of the photosensitive drum 11 is provided with the drum holder 40. The drum holder 40 comprises the shaft tip positioning collar 56 and the gap setting portion bearing 42*a*, and the gap setting portion bearing 42*a* abuts on the outer peripheral surface of the second bearing 44 disposed on the side of the developing roller 15 via the coupling portion 56*c*.

The gap regulating mechanism of the image forming unit according to a third embodiment of the present invention will next be described with reference to FIGS. 12 to 14. In the gap regulating mechanism according to the third embodiment, a constitution for assembling the image forming unit 10 provided with the gap regulating mechanism described in the first and second embodiments on the main body side of the tandem type image forming system, and a position relation when the photosensitive drum 11 and developing roller 15 are attached will particularly be described.

Figure 12:
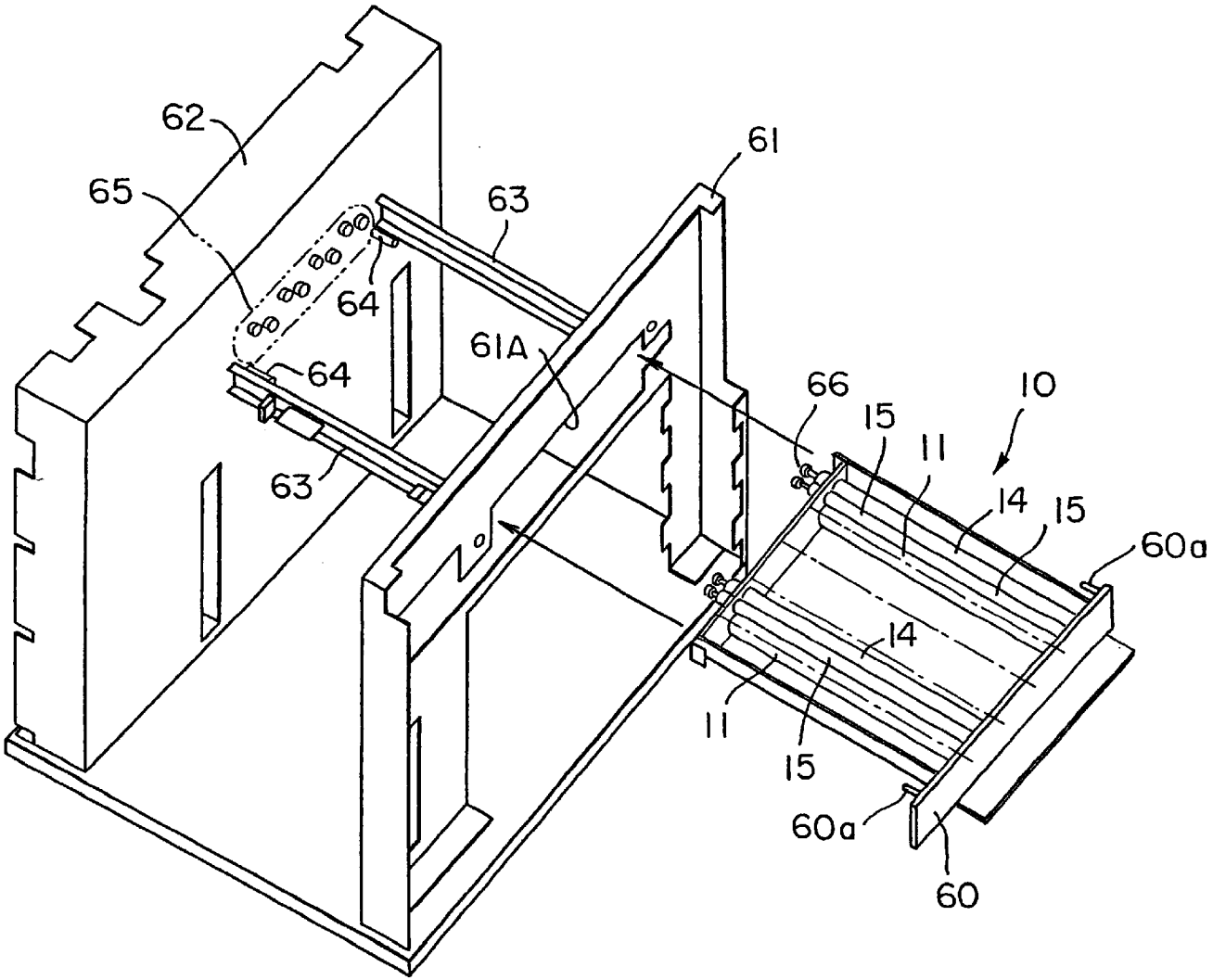
FIG. 12 is a perspective view showing an assembly state of the image forming unit to a main body side according to a third embodiment of the present invention.

In FIG. 12, a plurality of, for example, four photosensitive drums 11 and four developing rollers 15 to form pairs with the drums are assembled in a unit frame 60 and inserted in a direction of a rear frame 62 via an insertion port 61A of a front frame 61 on the main body side. During insertion, engagement places on the side of the unit frame 60 are fitted and inserted into a pair of guide rails 63, 63 bridged between the front frame 61 and the rear frame 62. In this case, two positioning studs 60*a*, 60*a* formed on the unit frame 60 are fitted into the front frame 61, and positioning studs 64, 64 disposed on the rear frame 62 are engaged with engagement holes formed in the rear side end surface of the unit frame 60. Additionally, in FIG. 12, among four pairs of photosensitive drums 11 and developing rollers 15 only two pairs on both sides are shown, and inner two pairs are omitted.

By the positioning studs and engagement holes disposed on the side of the front fame 61 and rear frame 62, after determining the attachment position of the unit frame 60 of the image forming unit, the unit frame 60 can be assembled to the front frame 61 and rear frame 62, but in this case, some distortion, collision of the frame against the frame, and the like sometimes occur. Even in this case, by disposing the displacement absorbing portion as shown in FIG. 9, the displacement around the shaft can be absorbed to some degree.

On a dead end to which the unit frame 60 is inserted, a plurality of hole portions 65 in which the rotation drive shaft 31 of the photosensitive drum 11 of the image forming unit 10, the rotation drive shaft 32 of the developing roller 15 and power supply portions are disposed are formed in corresponding places of the rear frame 62. After assembling the unit frame 60 to the front frame 61 and rear frame 62 according to the constitution shown in FIG. 12, respective main places of the image forming unit 10 are fixed by means such as screwing to complete the assembling.

Figures 13A, 13B:
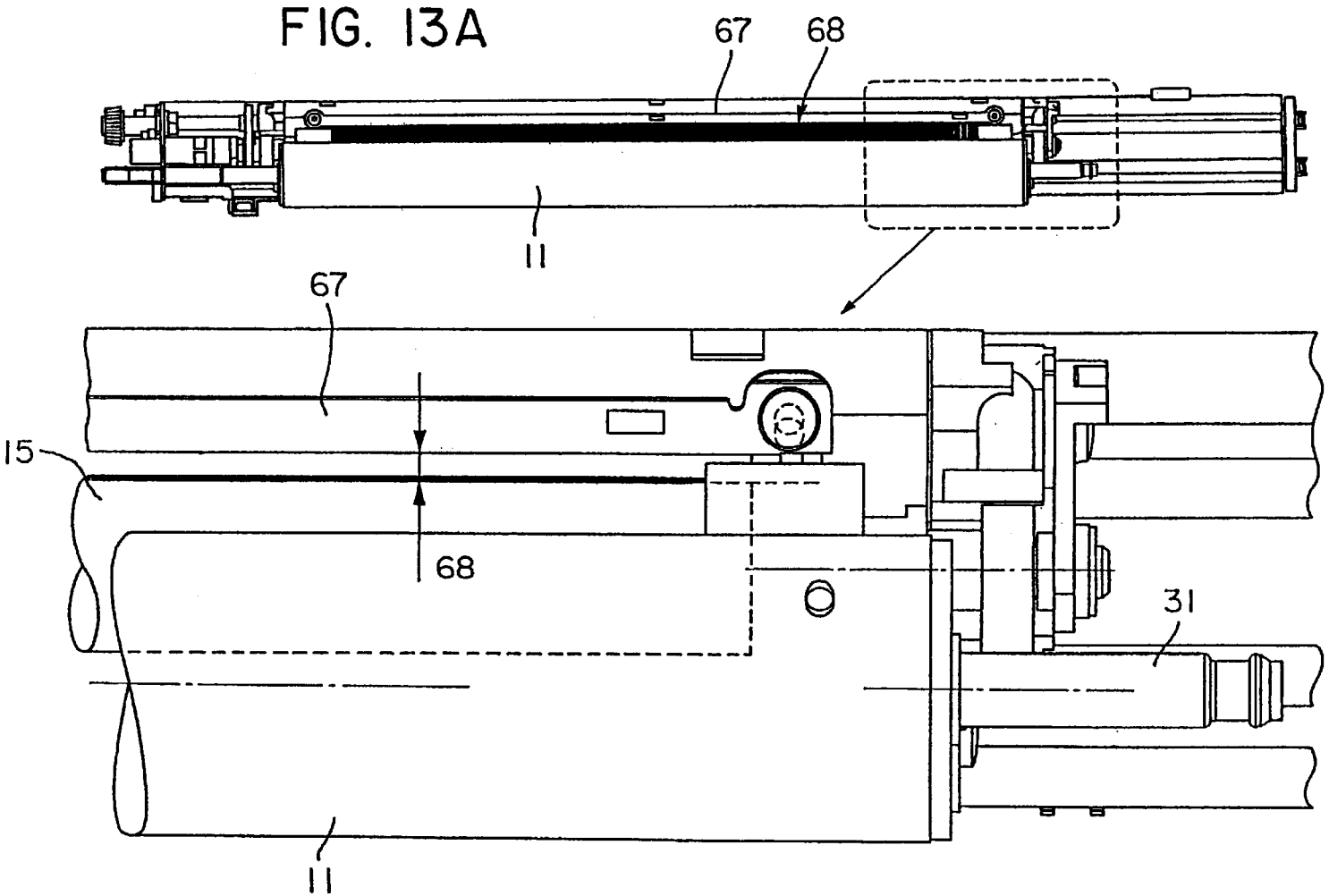
FIG. 13 is a plan view showing an attachment state and enlarged state of the photosensitive drum and developing roller in the image forming unit according to the third embodiment.

FIG. 13 is a side view showing a gap setting state between the photosensitive drum and the developing roller in the third embodiment, and in the drawing, the gap between the photosensitive drum 11 and the developing roller 15 is managed in such a manner that the predetermined gap is maintained by the gap regulating mechanism according to the constitution described in the first and second embodiments. Moreover, in the position opposite to the developing roller 15, disposed is a doctor blade 67 which is structured to regulate a height to be thin when the magnetic brush stands like the ears of rice and to supply the developing material to the peripheral surface of the photosensitive drum 11.

Figure 14:
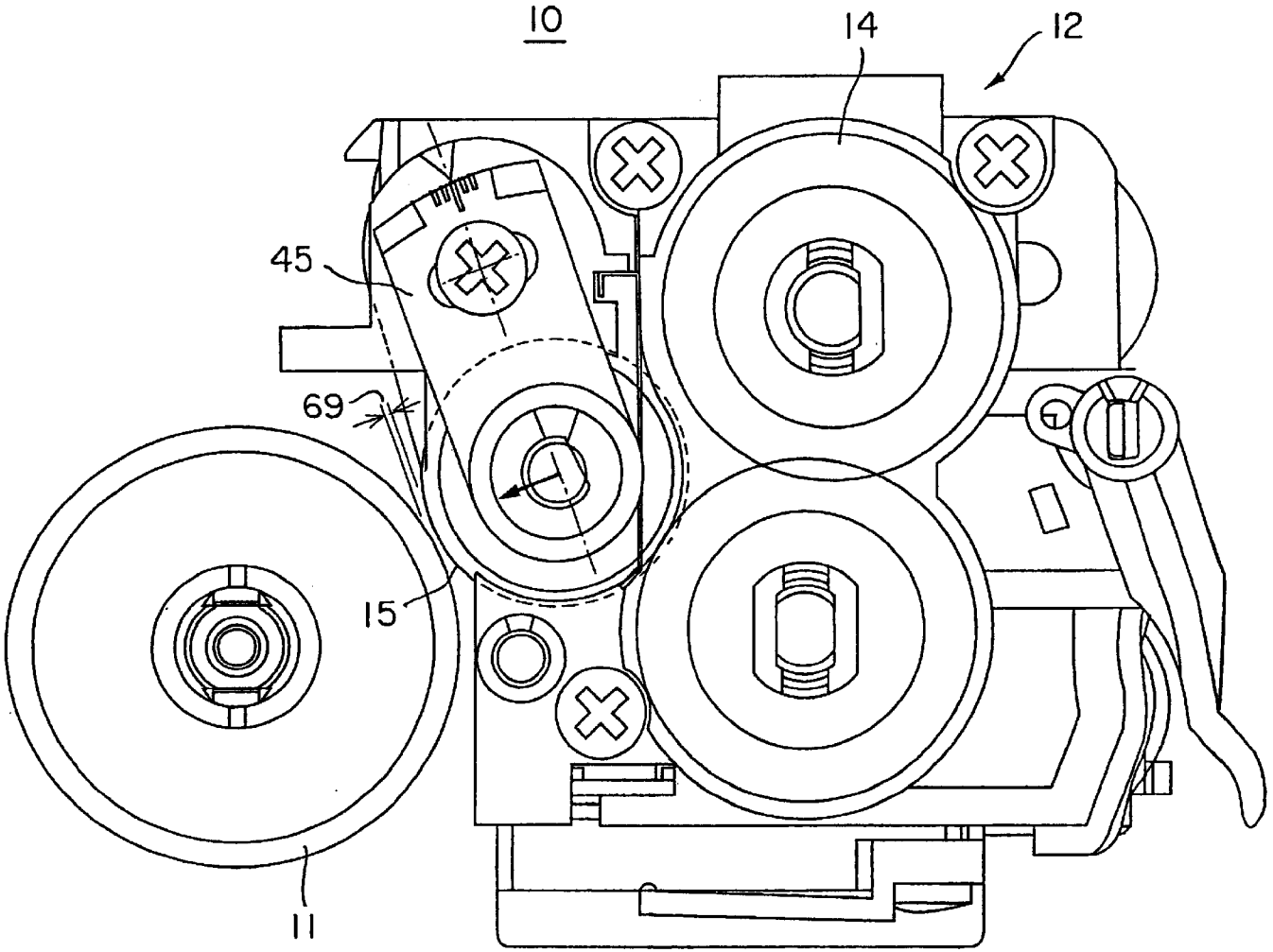
FIG. 14 is a front view, as seen from a main body front side, of the attachment state of the photosensitive drum and developing roller in the image forming unit according to the third embodiment.

FIG. 14 is an explanatory view of a position relation between the photosensitive drum 11 and the developing roller 15 in the image forming system according to the third embodiment, and FIG. 14 is a front view when the main body is viewed in a rear side direction from the front side of the main body. In FIG. 14, the photosensitive drum 11 is supported while the mutual position relation is regulated by the gap regulating mechanism 40 described in the first and second embodiments in such a manner that a fine gap 69 requiring management is maintained between the photosensitive drum and the developing roller 15 rotatably supported by the rotary lever 45. Additionally, the developing material is continuously supplied to the developing roller 15 by the developing unit 14.

Figure 15:
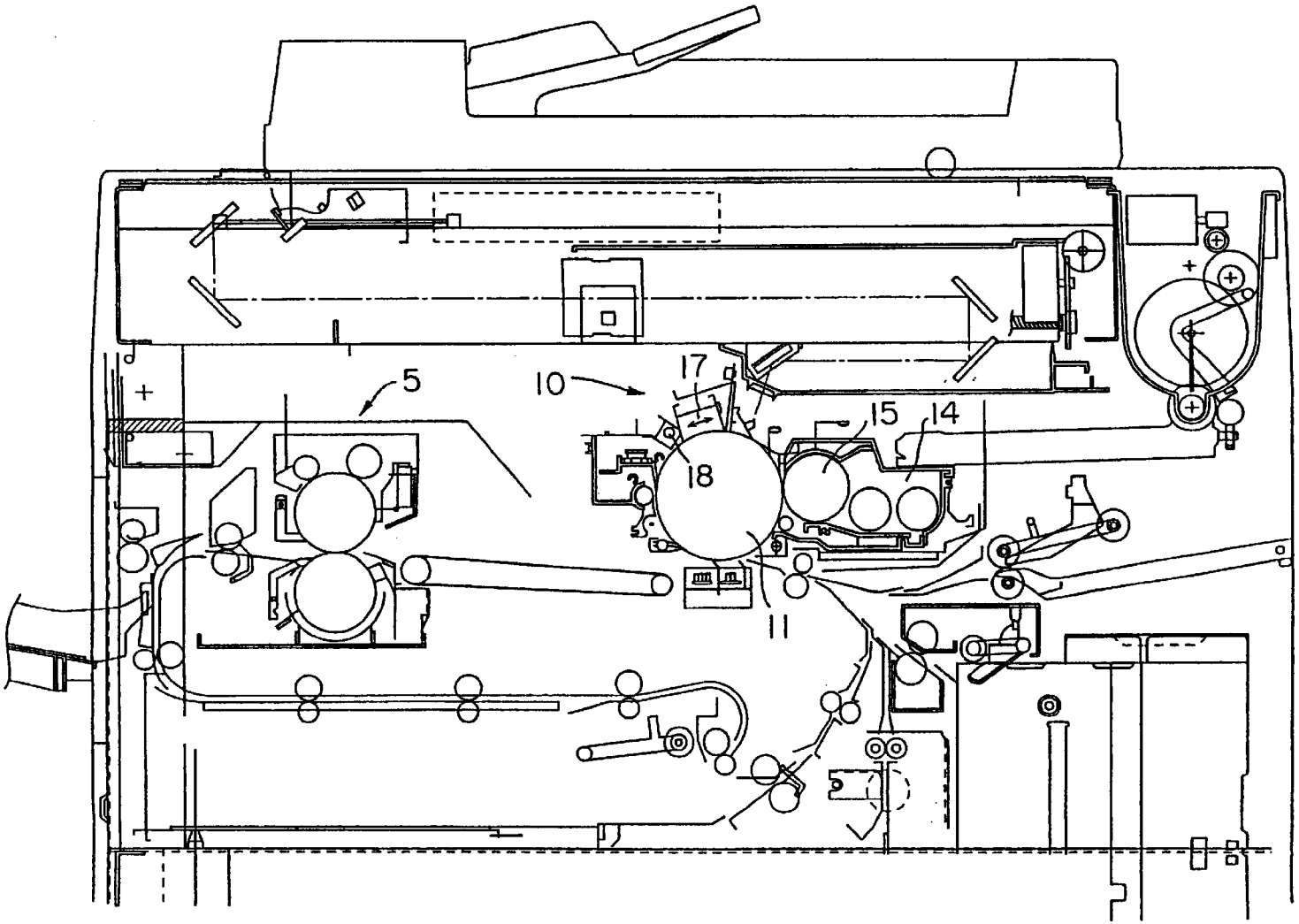
FIG. 15 is a sectional view of the image forming unit by a single photosensitive drum and a single developing roller.

Some examples of the image forming device to which the gap regulating mechanism of the image forming unit according to the present invention is attached will next be described. As described above, as shown in FIG. 15, the present invention can also be used when the gap in the attachment relation of the single large-diameter photosensitive drum to the single developing roller is set. In this case, since the photosensitive drum 11 has a large diameter, the outer peripheral portion of the drum holder may be enlarged in diameter only in a direction of position in the contact roller on the developing roller side, and abut on the contact roller. This can save an excessive space.

Alternatively, by attaching the contact roller with a slight large diameter to both ends of the developing roller 15 and thereby adjusting abutment state around the shaft of the photosensitive drum, the gap between the outer peripheral surfaces of the photosensitive drum 11 and developing roller 15 can be set to a desired distance. Additionally, in FIG. 15, numeral 17 denotes a charger for charging the photosensitive drum 11, and after the photosensitive drum 11 charged by the charger 17 rotates substantially once, electricity is removed by an electricity removing lamp 17, and charging is performed with respect to the next image again by the charger 17.

Figure 16:
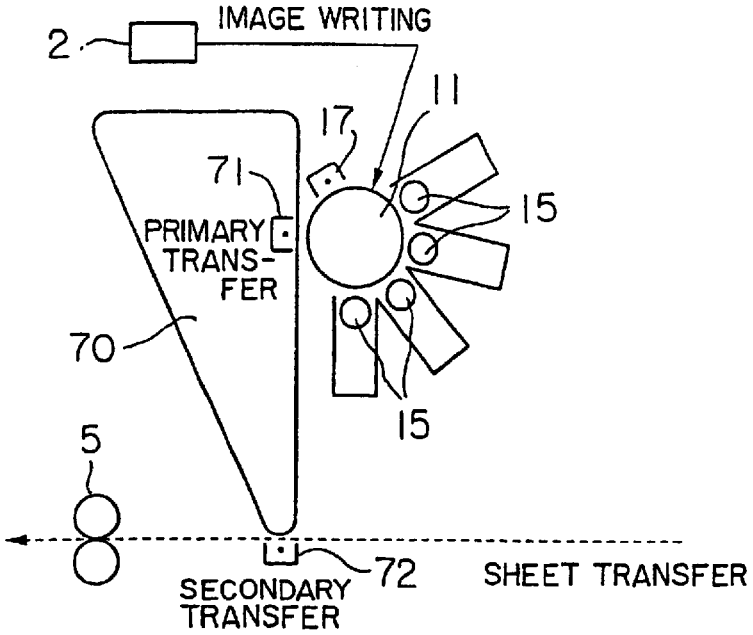
FIG. 16 is a sectional view showing the single photosensitive drum and a plurality of developing rollers for use in an intermediate transferring system of a multiple transferring system.

FIG. 16 is an explanatory view showing a case in which the present invention is applied to the image forming device of a multiple transferring system and an intermediate transferring system, in FIG. 16, a plurality of developing rollers 15 are arranged on the outer peripheral side of the single large-diameter photosensitive drum 11 in a satellite manner, and the gap regulating mechanism described in the first and second embodiments is disposed between the respective rotation drive shafts of the developing roller and photosensitive drum. In the image forming device of the intermediate transferring system, after an intermediate transferrer 70 is once subjected to primary transferring by a transferring portion 71, secondary transferring is performed by a transferring portion 72 to form the image on the sheet or the like, and even in the image forming device of the intermediate transferring system constituted as described above, the gap regulating mechanism according to the present invention can be used to set the gap between the outer peripheral surfaces of the photosensitive drum and developing roller to the desired distance.

Figure 17:
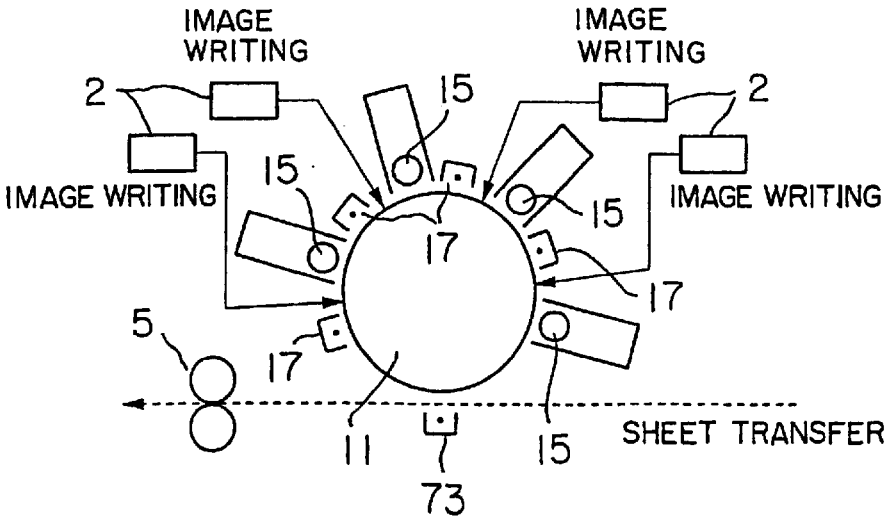
FIG. 17 is a sectional view showing the single photosensitive drum and the plurality of developing rollers for use in a one pass system of a multiple developing system.

FIG. 17 shows the image forming device of a multiple developing system and one pass system, and even in the image forming device of the multiple developing/one pass system the developing rollers 15 are arranged like satellites around the single large-diameter photosensitive drum 11. The gap regulating mechanism according to the present invention is attached between the respective rotation drive shafts of the photosensitive drum 11 and developing roller 15 to constantly adjust the gaps between the outer peripheral surface of the photosensitive drum and the respective outer peripheral surfaces of a plurality of developing rollers. The sheet as the image forming medium is supplied and conveyed as shown a dotted line in the drawing, and the image is formed on the photosensitive drum 11 by the developing material and subsequently transferred to the sheet in a transferring portion 73.

Figure 18:
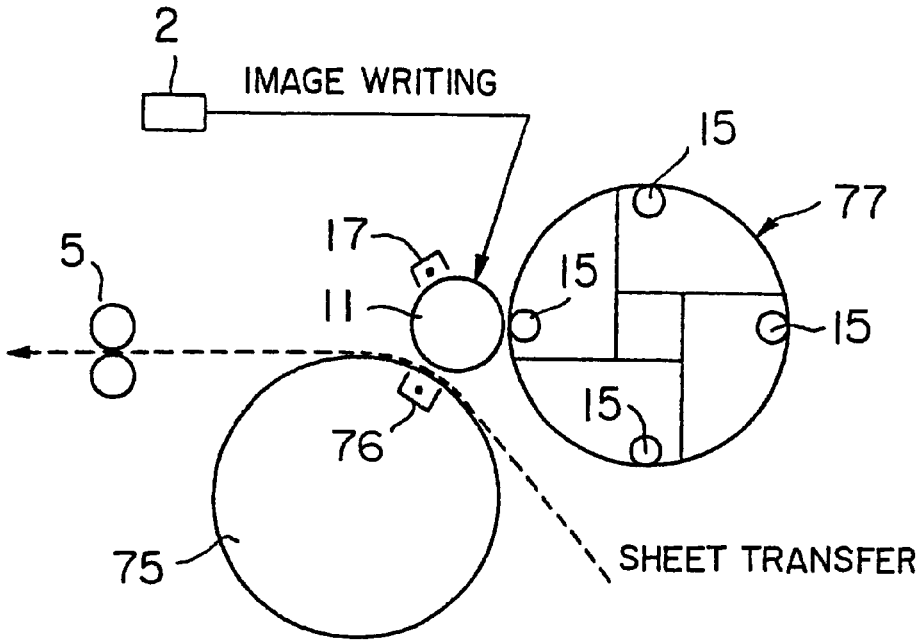
FIG. 18 is a sectional view showing a simplified model of a transferring drum structure of the multiple transferring system provided with a small-diameter photosensitive member, a large-diameter transferring drum and a rotary developing member provided with a plurality of developing rollers on a peripheral surface.

FIG. 18 shows the transferring drum structure of the multiple transferring system. In the image forming system by the transferring drum structure of the multiple transferring system, the image forming unit is provided with at least the small diameter roller-shaped photosensitive drum 11 as the image holding member, a transferring drum 75 provided with a large-diameter drum shape disposed on one side of the photosensitive drum 11 and provided with a transferring portion 76 on its peripheral surface, and a plurality of developing rollers 15, for respective colors of developing materials, disposed apart from one another by constant angles on the peripheral surface of a large-diameter drum 77 disposed on the other side of the photosensitive drum 11, and a final color image is obtained by successively forming the images of the respective color developing materials on the sheet as the image forming medium wound around the transferring drum 75. Even in the image forming system of the multiple transferring system transferring drum structure, by attaching the gap regulating mechanism according to the present invention to the mutual shafts of the developing roller for rotating in a revolver manner to successively/continuously develop the image on the photosensitive drum and the photosensitive drum, a desired action/effect can be achieved. Additionally, in this example, since a plurality of developing rollers 15 are disposed on the drum 77 rotating in the revolver manner, the gap regulating mechanism is constituted to set an optimum gap when the developing roller abuts on the photosensitive drum 11.

Figure 19:
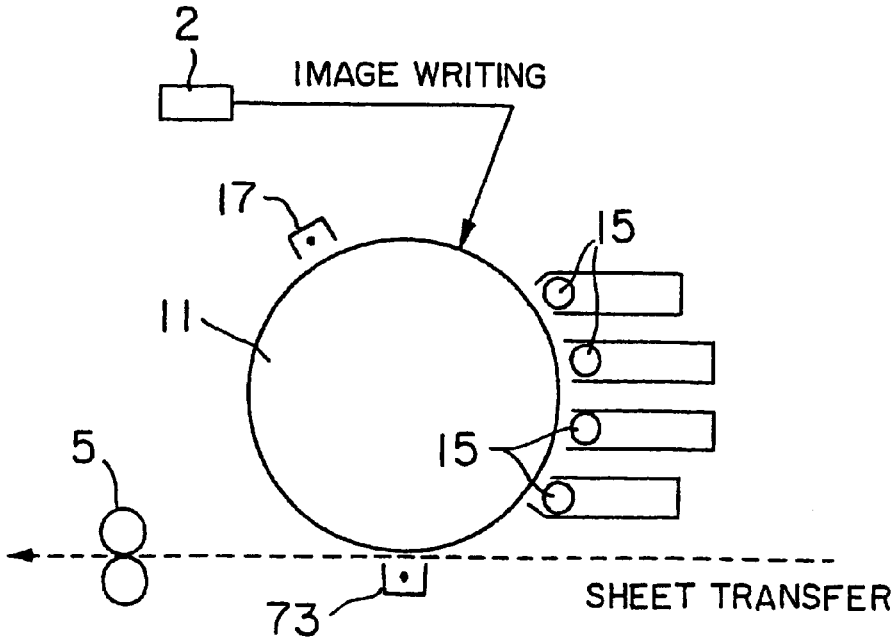
FIG. 19 is a sectional view showing a simplified model of a multiple rotation structure of the multiple developing system provided with a large-diameter photosensitive drum and a plurality of developing rollers arranged on a peripheral surface of the drum.

FIG. 19 shows the image forming system of a multiple rotation structure. The image forming unit in this system is provided with the large-diameter photosensitive drum 11 rotating multiple times as the image holding member, and a plurality of developing rollers 15, for the respective colors of developing materials, disposed opposite to the image forming surface of the photosensitive drum 11 and apart from one another by a predetermined angle, and the color image is obtained by rotating the photosensitive drum 11 multiple times and superposing the respective colors of developing materials on the image forming surface to perform collective transferring to the image forming medium.

Even in this example, the gap regulating mechanism according to the present invention can be applied, but the photosensitive drum 11 has a large diameter, and the gap setting portion is therefore constituted by a member with a diameter larger than that of the drum 11, and allowed to abut on the bearing on the side of the plurality of developing rollers 15, so that the gap between both can be adjusted and set to a desired value.

As described above, the present invention is not limited to the tandem type image forming system described in the first to third embodiments, and the gap between the respective outer peripheral surfaces of the single large-diameter photosensitive drum and the single or the plurality of developing rollers can be adjusted by setting the position between the respective rotation drive shafts. However, the tandem type image forming system is a most adaptable image forming system for the application of the present invention, and in this meaning the application of the present invention to the tandem type image forming system for forming the multiple color image is a best mode of the present invention.

What is claimed is:

1. An image forming system comprising: an image forming unit for forming an image by using a developing material; a medium supplying portion for supplying an image forming medium to the image forming unit; a medium conveying portion for conveying said supplied image forming medium; a medium supplying/conveying controller for controlling the supplying/conveying of the image forming medium to said image forming unit by said medium supplying portion and the medium conveying portion; a transferring portion for transferring said image developed by said image forming unit to said image forming medium; and a fixing portion for fixing the transferred image, wherein said image forming unit comprises:

an image holding member for converting an optical image formed via an optical system into a latent image and subsequently depositing said developing material thereon to hold the image on an image holding surface, said image holding member being provided with a support shaft movably fixed to a main body frame of said system;

a developing roller disposed in a developing portion for supplying said developing material to develop said latent image held on said image holding surface as the image with said developing material, said developing roller being provided with a rotation drive shaft for supplying said developing material to said image holding surface; and a gap regulating mechanism which includes at least a first bearing for holding said support shaft of said image holding member, a gap setting portion, disposed at a predetermined distance from the first bearing in a direction of said image holding member, for holding said support shaft in the vicinity of said image holding member in an assisting manner, and a second bearing for rotatably holding said rotation drive shaft of said developing roller from the side of a developer and maintaining a distance between the image holding surface of said image holding member and the peripheral surface of said developing roller between said second bearing itself and said gap setting portion, said gap regulating mechanism setting a gap between two surfaces in such a manner that a constant fine gap is always continued to be maintained between said gap setting portion and said second bearing, and wherein at least one of said first and second bearing is formed by a positioning collar which is fitted into an attachment place of the frame of an image forming unit fixed on a main body side of said image forming system and which loosely supports the support shaft of said photosensitive drum inside its diametric direction to regulate a large displacement alone of the support shaft.

2. The image forming system according to claim 1 wherein said gap regulating mechanism comprises: said first bearing and the gap setting portion laterally symmetrically disposed on both sides of a photosensitive drum as said image holding member; a coupling portion for coupling respective outer peripheral portions of said first bearing and the gap setting portion; said second bearing having an outer peripheral surface opposite to said gap setting portion right close to both ends of said photosensitive drum via the outer periphery of said coupling portion and having its inner peripheral surface fitted into the rotation drive shaft of said developing roller; and an urging member for urging said developing roller in the direction of said image holding surface of said image holding member.

3. The image forming system according to claim 1 wherein at least one of a pair of said gap setting portions is constituted by a fixing member, and one end of said fixing member abuts on said support shaft and the other end thereof abuts on said second bearing to set a gap between said image forming surface of said photosensitive drum supported by said support shaft and the outer surface of said developing roller.

4. The image forming system according to claim 1 wherein said image forming unit is provided with a plurality of photosensitive drums as said image holding member, and a plurality of developing units as a developer for forming a pair with each of the photosensitive drums, at least said plurality of photosensitive drums are arranged in parallel in a tandem structure, and the plurality of photosensitive drums and the plurality of developing units are assembled in one image forming unit case.

5. The image forming system according to claim 1 wherein said image forming unit has a transferring drum structure provided with a single photosensitive drum as said image holding member and a single developing roller as said developer.

6. The image forming system according to claim 1 wherein said image forming unit has an intermediate transferring structure provided with a single photosensitive drum as said image holding member, a plurality of developing rollers as the developer provided with different colors of developing materials disposed apart from one another via a predetermined angle around the photosensitive drum, and an intermediate transferrer for successively transferring the respective colors of developing materials formed on said photosensitive drum.

7. The image forming system according to claim 1 wherein said image forming unit has a multiple developing structure of one pass system which includes a single large-diameter photosensitive drum as said image holding member, and a plurality of developing rollers as said developer provided with different colors of developing materials apart from one another via a predetermined angle around the photosensitive drum, and which transfers a color image obtained by superposing the developing materials on the image holding surface of said photosensitive drum onto said sheet by passing the sheet as said image forming medium once to obtain the formed image.

8. The image forming system according to claim 1 wherein said image forming unit has a transferring drum structure which comprises at least a small-diameter roller-shaped photosensitive member as said image holding member, a transferring drum provided with a large-diameter drum shape disposed on one side of the photosensitive member and the transferring portion on the peripheral surface of the drum shape, and a plurality of developing rollers for the respective developing materials disposed apart from one another by a constant angle on the peripheral surface of a large-diameter drum disposed on the other side of said photosensitive member, and which successively forms the images of respective color developing materials on the image forming medium wound around said transferring drum to obtain a final color image.

9. The image forming system according to claim 1 wherein said image forming unit has a multiple rotation structure which comprises a large-diameter multiple-rotation photosensitive drum as said image holding member, and a plurality of developing rollers for respective colors of developing materials disposed opposite to said image forming surface of the photosensitive drum and apart from one another by a predetermined angle, and which rotates said photosensitive drum multiple times to superpose the respective colors of developing materials on said image forming surface and then collectively transferring them to the image forming medium to obtain the color image.

10. An image forming system comprising: an image forming unit for forming an image by using a developing material; a medium supplying portion for supplying an image forming medium to the image forming unit; a medium conveying portion for conveying said supplied image forming medium; a medium supplying/conveying controller for controlling the supplying/conveying of the image forming medium to said image forming unit by said medium supplying portion and the medium conveying portion; a transferring portion for transferring said image developed by said image forming unit to said image forming medium; and a fixing portion for fixing the transferred image, wherein said image forming unit comprises:

an image holding member for converting an optical image formed via an optical system into a latent image and subsequently depositing said developing material thereon to hold the image on an image holding surface, said image holding member being provided with a support shaft movably fixed to a main body frame of said system;

a developing roller disposed in a developing portion for supplying said developing material to develop said latent image held on said image holding surface as the image with said developing material, said developing roller being provided with a rotation drive shaft for supplying said developing material to said image holding surface; and a gap regulating mechanism which includes at least a first bearing for holding said support shaft of said image holding member, a gap setting portion, disposed at a predetermined distance from the first bearing in a direction of said image holding member, for holding said support shaft in the vicinity of said image holding member in an assisting manner, and a second bearing for rotatably holding said rotation drive shaft of said developing roller from the side of a developer and maintaining a distance between the image holding surface of said image holding member and the peripheral surface of said developing roller between said second bearing itself and said gap setting portion, said gap regulating mechanism setting a gap between two surfaces in such a manner that a constant fine gap is always continued to be maintained between said gap setting portion and said second bearing, wherein said gap regulating mechanism comprises: said first bearing and the gap setting portion laterally symmetrically disposed on both sides of a photosensitive drum as said image holding member; a coupling portion for coupling respective outer peripheral portions of said first bearing and the gap setting portion; said second bearing having an outer peripheral surface opposite to said gap setting portion right close to both ends of said photosensitive drum via the outer periphery of said coupling portion and having its inner peripheral surface fitted into the rotation drive shaft of said developing roller; and an urging member for urging said developing roller in the direction of said image holding surface of said image holding member, and wherein at least one of said coupling portions for coupling outer peripheral sides of said first bearing and said gap setting portion is constituted by an elastic member for absorbing, by an elastic force, external action forces including deflection, distortion and eccentric action applied to said support shaft passed inside the diametric direction.

11. The image forming system according to claim 10 wherein said elastic member is formed of a thin member as compared with an ordinary coupling member, and elastically deformed to absorb the external action force when said external action force is applied around the support shaft to such an extent that the ordinary coupling member fails to be elastically deformed.

12. The image forming system according to claim 10 wherein said elastic member is constituted of a plurality of coupling pieces for bridging said first bearing and said gap setting portion, portions other than the plurality of coupling pieces are a plurality of openings which are lighted and opened, and said plurality of elastic pieces are deformed to absorb the external action force when said external action force is applied around said support shaft to such an extent that the ordinary coupling member fails to be elastically deformed.

13. An image forming system comprising: an image forming unit for forming an image by using a developing material; a medium supplying portion for supplying an image forming medium to the image forming unit; a medium conveying portion for conveying said supplied image forming medium; a medium supplying/conveying controller for controlling the supplying/conveying of the image forming medium to said image forming unit by said medium supplying portion and the medium conveying portion; a transferring portion for transferring said image developed by said image forming unit to said image forming medium; and a fixing portion for fixing the transferred image, wherein said image forming unit comprises:

an image holding member for converting an optical image formed via an optical system into a latent image and subsequently depositing said developing material thereon to hold the image on an image holding surface, said image holding member being provided with a support shaft movably fixed to a main body frame of said system;

a developing roller disposed in a developing portion for supplying said developing material to develop said latent image held on said image holding surface as the image with said developing material, said developing roller being provided with a rotation drive shaft for supplying said developing material to said image holding surface; and a gap regulating mechanism which includes at least a first bearing for holding said support shaft of said image holding member, a gap setting portion, disposed at a predetermined distance from the first bearing in a direction of said image holding member, for holding said support shaft in the vicinity of said image holding member in an assisting manner, and a second bearing for rotatably holding said rotation drive shaft of said developing roller from the side of a developer and maintaining a distance between the image holding surface of said image holding member and the peripheral surface of said developing roller between said second bearing itself and said gap setting portion, said gap regulating mechanism setting a gap between two surfaces in such a manner that a constant fine gap is always continued to be maintained between said gap setting portion and said second bearing, wherein said gap regulating mechanism comprises: said first bearing and the gap setting portion laterally symmetrically disposed on both sides of a photosensitive drum as said image holding member; a coupling portion for coupling respective outer peripheral portions of said first bearing and the gap setting portion; said second bearing having an outer peripheral surface opposite to said gap setting portion right close to both ends of said photosensitive drum via the outer periphery of said coupling portion and having its inner peripheral surface fitted into the rotation drive shaft of said developing roller; and an urging member for urging said developing roller in the direction of said image holding surface of said image holding member, and at least one of said first bearings is formed by a positioning collar which is fitted into an attachment place of the frame of an image forming unit fixed on a main body side of said image forming system and which loosely supports the support shaft of said photosensitive drum inside its diametric direction to regulate a large displacement alone of the support shaft.

14. An image forming system comprising: an image forming unit for forming an image by using a developing material; a medium supplying portion for supplying an image forming medium to the image forming unit; a medium conveying portion for conveying said supplied image forming medium; a medium supplying/conveying controller for controlling the supplying/conveying of the image forming medium to said image forming unit by said medium supplying portion and the medium conveying portion; a transferring portion for transferring said image developed by said image forming unit to said image forming medium; and a fixing portion for fixing the transferred image, wherein said image forming unit comprises:

an image holding member for converting an optical image formed via an optical system into a latent image and subsequently depositing said developing material thereon to hold the image on an image holding surface, said image holding member being provided with a support shaft movably fixed to a main body frame of said system;

a developing roller disposed in a developing portion for supplying said developing material to develop said latent image held on said image holding surface as the image with said developing material, said developing roller being provided with a rotation drive shaft for supplying said developing material to said image holding surface; and a gap regulating mechanism which includes at least a first bearing for holding said support shaft of said image holding member, a gap setting portion, disposed at a predetermined distance from the first bearing in a direction of said image holding member, for holding said support shaft in the vicinity of said image holding member in an assisting manner, and a second bearing for rotatably holding said rotation drive shaft of said developing roller from the side of a developer and maintaining a distance between the image holding surface of said image holding member and the peripheral surface of said developing roller between said second bearing itself and said gap setting portion, said gap regulating mechanism setting a gap between two surfaces in such a manner that a constant fine gap is always continued to be maintained between said gap setting portion and said second bearing, wherein a peripheral edge of a frame side holding portion of the image forming unit for holding the first bearing constituting said gap regulating mechanism includes a plurality of peripheral holes and a plurality of coupling pieces for coupling a frame between the respective peripheral holes, and has a plastically deformable displacement absorbing structure.

15. An image forming system comprising: an image forming unit for forming an image by using a developing material; a medium supplying portion for supplying an image forming medium to the image forming unit; a medium conveying portion for conveying said supplied image forming medium; a medium supplying/conveying controller for controlling the supplying/conveying of the image forming medium to said image forming unit by said medium supplying portion and the medium conveying portion; a transferring portion for transferring said image developed by said image forming unit to said image forming medium; and a fixing portion for fixing the transferred image, wherein said image forming unit comprises:

an image holding member for converting an optical image formed via an optical system into a latent image and subsequently depositing said developing material thereon to hold the image on an image holding surface, said image holding member being provided with a support shaft movably fixed to a main body frame of said system;

a developing roller disposed in a developing portion for supplying said developing material to develop said latent image held on said image holding surface as the image with said developing material, said developing roller being provided with a rotation drive shaft for supplying said developing material to said image holding surface; and a gap regulating mechanism which includes at least a first bearing for holding said support shaft of said image holding member, a gap setting portion, disposed at a predetermined distance from the first bearing in a direction of said image holding member, for holding said support shaft in the vicinity of said image holding member in an assisting manner, and a second bearing for rotatably holding said rotation drive shaft of said developing roller from the side of a developer and maintaining a distance between the image holding surface of said image holding member and the peripheral surface of said developing roller between said second bearing itself and said gap setting portion, said gap regulating mechanism setting a gap between two surfaces in such a manner that a constant fine gap is always continued to be maintained between said gap setting portion and said second bearing, wherein at least one of a pair of said first bearings is constituted by a bearing provided with an inner race into which said support shaft is fitted, an outer race which is fitted into said main body frame, and a ball sealed between said inner race and said outer race.

16. An image forming system comprising: an image forming unit for forming an image by using a developing material; a medium supplying portion for supplying an image forming medium to the image forming unit; a medium conveying portion for conveying said supplied image forming medium; a medium supplying/conveying controller for controlling the supplying/conveying of the image forming medium to said image forming unit by said medium supplying portion and the medium conveying portion; a transferring portion for transferring said image developed by said image forming unit to said image forming medium; and a fixing portion for fixing the transferred image, wherein said image forming unit comprises:

an image holding member for converting an optical image formed via an optical system into a latent image and subsequently depositing said developing material thereon to hold the image on an image holding surface, said image holding member being provided with a support shaft movably fixed to a main body frame of said system;

a developing roller disposed in a developing portion for supplying said developing material to develop said latent image held on said image holding surface as the image with said developing material, said developing roller being provided with a rotation drive shaft for supplying said developing material to said image holding surface; and a gap regulating mechanism which includes at least a first bearing for holding said support shaft of said image holding member, a gap setting portion, disposed at a predetermined distance from the first bearing in a direction of said image holding member, for holding said support shaft in the vicinity of said image holding member in an assisting manner, and a second bearing for rotatably holding said rotation drive shaft of said developing roller from the side of a developer and maintaining a distance between the image holding surface of said image holding member and the peripheral surface of said developing roller between said second bearing itself and said gap setting portion, said gap regulating mechanism setting a gap between two surfaces in such a manner that a constant fine gap is always continued to be maintained between said gap setting portion and said second bearing, wherein at least one of a pair of said first bearings is constituted by a sliding shaft bearing whose inner peripheral surface contacts the peripheral surface of a rotation drive shaft as said support shaft to support the rotation of said rotation drive shaft.

17. An image forming system comprising: an image forming unit for forming an image by using a developing material; a medium supplying portion for supplying an image forming medium to the image forming unit; a medium conveying portion for conveying said supplied image forming medium; a medium supplying/conveying controller for controlling the supplying/conveying of the image forming medium to said image forming unit by said medium supplying portion and the medium conveying portion; a transferring portion for transferring said image developed by said image forming unit to said image forming medium; and a fixing portion for fixing the transferred image, wherein said image forming unit comprises: a photosensitive drum for converting an optical image formed via an optical system into a latent image and subsequently depositing said developing material thereon to hold the image on an image holding surface, said photosensitive drum being provided with a support shaft movably fixed to a main body frame of said system;

a developing roller provided with a rotation drive shaft for supplying said developing material to said image holding surface to develop said latent image held on said image holding surface as the image by said developing material; and a gap regulating mechanism which includes at least first shaft holding means for holding said support shaft of said image holding member, gap setting means, disposed at a predetermined distance from the first shaft holding means in a direction of said image holding member, for holding said support shaft in the vicinity of said image holding member in an assisting manner, coupling means for coupling outer peripheral portions of said first shaft holding means and said gap setting means, second shaft holding means for rotatably holding said rotation drive shaft of said developing roller from the side of said developing means and maintaining a distance between the image holding surface of said image holding member and the peripheral surface of said developing roller between said second shaft holding means itself and said gap setting means, said second shaft holding means being provided with an outer peripheral surface opposite to said gap setting means right close to both ends of said photosensitive drum via an outer periphery of said coupling means and an inner peripheral surface fitted into the rotation drive shaft of said developing roller, and urging means for urging said developing roller in the direction of said image holding surface of said image holding member, and which sets a gap between two surfaces in such a manner that said first shaft holding means and said gap setting means are laterally symmetrically disposed on both sides of said photosensitive drum and a constant fine gap continues to be maintained between said gap setting means and said second shaft holding means, and wherein at least one of said first and second shaft holding means is formed by a positioning collar which is fitted into an attachment place of the frame of an image forming unit fixed on a main body side of said image forming system and which loosely supports the support shaft of said photosensitive drum inside its diametric direction to regulate a large displacement alone of the support shaft.

18. An image forming system comprising: image forming means for forming an image by using a developing material; medium supplying means for supplying an image forming medium to the image forming means; medium conveying means for conveying the supplied image forming medium; a medium supplying/conveying control means for controlling the supplying/conveying of the image forming medium to said image forming means by said medium supplying means and the image forming medium conveying means; transferring means for transferring said image developed by said image forming means to said image forming medium; and fixing means for fixing the transferred image, wherein said image forming means comprises: a an image holding member for converting an optical image formed via an optical system into a latent image and subsequently depositing said developing material thereon to hold the image on an image holding surface, said image holding member being provided with a support shaft movably fixed to a main body frame of said system; a developing roller disposed in said developing means for supplying said developing material to develop said latent image held on said image holding surface as the image by said developing material, and provided with a rotation drive shaft for supplying said developing material to said image holding surface; and a gap regulating mechanism which includes at least first shaft holding means for holding said support shaft of said image holding member, gap setting means, disposed at a predetermined distance from the first shaft holding means in a direction of said image holding member, for holding said support shaft in the vicinity of said image holding member in an assisting manner, and second shaft holding means for rotatably holding said rotation drive shaft of said developing roller from the side of said developing means and maintaining a distance between the image holding surface of said image holding member and the peripheral surface of said developing roller between the second shaft holding means itself and said gap setting means, and which sets a gap between two surfaces in such a manner that a constant fine gap always continues to be maintained between said gap setting means and said second shaft holding means, said gap regulating mechanism comprises: said first shaft holding means and said gap setting means laterally symmetrically disposed on both sides of a photosensitive drum as said image holding member; coupling means for coupling outer peripheral portions of said first shaft holding means and the gap setting means with each other; said second shaft holding means provided with an outer peripheral surface opposite to said gap setting means right close to both ends of said photosensitive drum via an outer periphery of said coupling means and an inner peripheral surface fitted into the rotation drive shaft of said developing roller; and urging means for urging said developing roller in the direction of said image holding surface of said image holding member, and at least one of said first shaft holding means is formed by a positioning collar which is fitted into an attachment place of the frame of an image forming unit fixed on a main body side of said image forming system and which loosely supports the support shaft of said photosensitive drum inside its diametric direction to regulate a large displacement alone of the support shaft.

* * * * *